US008186980B2

(12) United States Patent
Komai et al.

(10) Patent No.: US 8,186,980 B2
(45) Date of Patent: May 29, 2012

(54) SCROLL-TYPE FLUID MACHINE THAT REDUCES CENTRIFUGAL FORCE OF AN ORBITING SCROLL

(75) Inventors: Yuji Komai, Tokyo (JP); Kazutaka Suefuji, Kanagawa (JP); Toshikazu Harashima, Tokyo (JP); Kiminori Iwano, Kanagawa (JP); Toshitsugu Suzuki, Tokyo (JP); Yoshiyuki Kanemoto, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 517 days.

(21) Appl. No.: 12/382,982

(22) Filed: Mar. 27, 2009

(65) Prior Publication Data

US 2009/0246058 A1 Oct. 1, 2009

(30) Foreign Application Priority Data

Mar. 31, 2008 (JP) ..... 2008-093165
Feb. 24, 2009 (JP) ..... 2009-040968

(51) Int. Cl.
*F03C 4/00* (2006.01)
*F04C 18/00* (2006.01)

(52) U.S. Cl. ..... 418/55.3; 418/55.5; 418/57; 464/102

(58) Field of Classification Search ..... 418/55.1–55.6, 418/57, 270; 464/102, 103
See application file for complete search history.

(56) References Cited

U.S. PATENT DOCUMENTS 5,775,888 A * 7/1998 Sakamoto et al. ..... 418/55.2
6,592,345 B2 * 7/2003 Suefuji et al. ..... 418/55.4
7,044,722 B2 * 5/2006 Fujioka et al. ..... 418/55.3

FOREIGN PATENT DOCUMENTS

JP 06213174 A * 8/1994
JP 11-082328 A 3/1999
JP 2002-227779 A 8/2002

OTHER PUBLICATIONS

Chinese Office Action dated Aug. 13, 2010 (five (5) pages).

* cited by examiner

*Primary Examiner* — Theresa Trieu
(74) *Attorney, Agent, or Firm* — Crowell & Moring LLP

(57) ABSTRACT

A scroll-type fluid machine comprising: a casing; a fixed scroll; an orbiting scroll; and an auxiliary crank device in which to prevent the orbiting scroll from being rotated, wherein the auxiliary crank device comprises: a fixed-side bearing body provided on either a casing side or a fixed scroll side; an orbiting-side bearing body provided on an orbiting scroll side; and an auxiliary crank shaft in which a fixed-side shank is rotatably supported with the fixed-side bearing body, and an orbiting-side shank is rotatably supported with the orbiting-side bearing body; a tip of the fixed-side shank of the auxiliary crank shaft is fixed in a radius direction, and a tip of the orbiting-side shank of the auxiliary crank shaft is fixed in a radius direction; and a deformative portion is provided between the tip of the fixed-side shank and the tip of the orbiting-side shank of the auxiliary crank shaft.

4 Claims, 16 Drawing Sheets

SCROLL-TYPE FLUID MACHINE THAT REDUCES CENTRIFUGAL FORCE OF AN ORBITING SCROLL

BACKGROUND OF THE INVENTION

1. Field of the Invention

The present invention relates to a scroll-type fluid machine suitable for a compressor for fluid such as air, a vacuum pump, an expansion device, and the like.

2. Description of the Related Art

In general, a scroll-type fluid machine can be categorized into a compressor compressing fluid such as air or refrigerant, a vacuum pump depressurizing an interior of a container, an expansion device expanding fluid, and the like. This type of the scroll-type fluid machine generally comprises: a casing; a fixed scroll fixed to the casing wherein a spiroid lap portion is standing on a surface of an end plate; an orbiting scroll provided with a spiroid lap portion standing on a surface of an end plate, the orbiting scroll forming a plurality of fluid chambers so as to compress or expand fluid between the fixed scroll and the orbiting scroll through orbiting motion; a driving shaft rotatably provided within the casing so as to allow the orbiting scroll to move in an orbital manner; and an auxiliary crank device provided between the casing and the orbiting scroll so as to prevent the orbiting scroll from being rotated. See, for example, Japanese Patent Application Laid-Open No. H11-82328 (hereinafter referred to as the patent document 1).

In conventional scroll-type fluid machines, spiral lap portions are each provided on surfaces of end plates composed of a fixed scroll and an orbiting scroll, whereby a plurality of fluid chambers are formed by superimposing each of the lap portions one another. Further, in the scroll-type fluid machines, the orbiting scroll is moved in an orbital manner through a driving shaft by means of a driving source such as a motor. Accordingly, fluid such as air or refrigerant can be sequentially compressed within each of the fluid chambers.

Furthermore, an auxiliary crank device comprises: a fixed-side bearing portion provided with a casing; an orbiting-side bearing portion provided with the orbiting scroll; and an auxiliary crank shaft, one side of which is rotatably supported with the fixed-side bearing portion while the other side of which is rotatably supported with the orbiting-side bearing portion. Here, eccentric measurements of the one side and the other side of the auxiliary crank shaft are set identical with an orbiting radius where the orbiting scroll moves in an orbital manner. Accordingly, the auxiliary crank device can prevent the orbiting scroll from being rotated when the orbiting scroll moves in an orbital manner.

Considering the conventional scroll-type fluid machines, centrifugal force will be generated along with orbiting motion of the orbiting scroll. This centrifugal force of the orbiting scroll is separately supported by bearings of the driving shaft and the auxiliary crank device. Accordingly, in case, for example, the orbiting scroll moves in an orbital manner at a high speed, excessive centrifugal force may apply to the auxiliary crank device, thereby possibly lowering durability of the auxiliary crank device.

SUMMARY OF THE INVENTION

The present invention has been made in light of the above problems, and it is an object of the present invention to provide a scroll-type fluid machine that can reduce centrifugal force of an orbiting scroll, which is applied to an auxiliary crank device.

In order to achieve the object described above, according to a first aspect of the present invention, there is provided with a scroll-type fluid machine comprising: a casing; a fixed scroll with a spiral lap portion vertically standing on a surface of an end plate, the fixed scroll being fixed to the casing; an orbiting scroll with a spiral lap portion vertically standing on a surface of an end plat, the orbiting scroll forming a plurality of fluid chambers between the fixed scroll and the orbiting scroll so as to compress or expand fluid in orbiting motion of the orbiting scroll; and an auxiliary crank device in which to prevent the orbiting scroll from being rotated, wherein: the auxiliary crank device comprises: a fixed-side bearing body provided on either a casing side or a fixed scroll side; an orbiting-side bearing body provided on an orbiting scroll side; and an auxiliary crank shaft in which a fixed-side shank is rotatably supported with the fixed-side bearing body, and an orbiting-side shank is rotatably supported with the orbiting-side bearing body; a tip portion of the fixed-side shank of the auxiliary crank shaft is fixed in a radius direction, and a tip portion of the orbiting-side shank of the auxiliary crank shaft is fixed in a radius direction; and between the tip portion of the fixed-side shank and the tip portion of the orbiting-side shank of the auxiliary crank shaft, a deformative portion allowed to be deformed in a radius direction is provided.

According to a second aspect of the present invention, there is provided with a scroll-type fluid machine comprising: a casing; a fixed scroll with a spiral lap portion vertically standing on a surface of an end plate, the fixed scroll being fixed to the casing; an orbiting scroll with a spiral lap portion vertically standing on a surface of an end plat, the orbiting scroll forming a plurality of fluid chambers between the fixed scroll and the orbiting scroll so as to compress or expand fluid with orbiting motion of the orbiting scroll; and an auxiliary crank device in which to prevent the orbiting scroll from being rotated, wherein: the auxiliary crank device comprises: a fixed-side bearing body provided on either a casing side or a fixed scroll side; an orbiting-side bearing body provided on an orbiting scroll side; and an auxiliary crank shaft in which a fixed-side shank is rotatably supported with the fixed-side bearing body, and an orbiting-side shank is rotatably supported with the orbiting-side bearing body; a tip portion of the fixed-side shank of the auxiliary crank shaft is fixed in a radius direction, and a tip portion of the orbiting-side shank of the auxiliary crank shaft is fixed in a radius direction; and on at least one of the shanks of the auxiliary crank shaft, the fixed-side shank and the orbiting-side shank, an unconstraint portion is provided at a basal portion of the shank so that the shank is movable in a radius direction.

According to a third aspect of the present invention, a scroll-type fluid machine comprising: a casing; a fixed scroll with a spiral lap portion vertically standing on a surface of an end plate, the fixed scroll being fixed to the casing; an orbiting scroll with a spiral lap portion vertically standing on a surface of an end plat, the orbiting scroll forming a plurality of fluid chambers between the fixed scroll and the orbiting scroll so as to compress or expand fluid in orbiting motion of the orbiting scroll; and an auxiliary crank device in which to prevent the orbiting scroll from being rotated, wherein: the auxiliary crank device comprises: a fixed-side bearing body placed on either a casing side or a fixed scroll side and provided with an inner ring relatively rotatable and an outer ring; an orbiting-side bearing body placed on an orbiting scroll side and provided with an inner ring relatively rotatable and an outer ring; and an auxiliary crank shaft in which a fixed-side shank is supported with the fixed-side bearing body rotatably and unmovably in its axial direction, and an orbiting-side shank is supported with the orbiting-side bearing body rotatably and unmovably in its axial direction; a tip portion of the fixed-side shank of the auxiliary crank shaft is inserted into the inner ring of the fixed-side bearing body so as to be fixed in its radius direction, and a tip portion of the orbiting-side shank of the auxiliary crank shaft is inserted into the inner ring of the orbiting-side bearing body so as to be fixed in its radius direction; and on at least one of the shanks of the auxiliary crank shaft, the fixed-side shank and the orbiting-side shank, an unconstraint portion is provided at a basal portion of the shank so that the shank is movable in its radius direction for allowing a tip portion of the shank oscillatable, wherein at least one of the shanks arranged with the unconstraint portion, the fixed-side bearing body and the orbiting-side bearing body, is provided with an axial clearance between an axial end surface of the inner ring and the auxiliary crank shaft.

DETAILED DESCRIPTION OF THE INVENTION

Hereinbelow, an oilless scroll-type air compressor will be exemplified for explaining a scroll-type fluid machine according to an embodiment of the present invention, with reference to the accompanying drawings.

Figure 1:
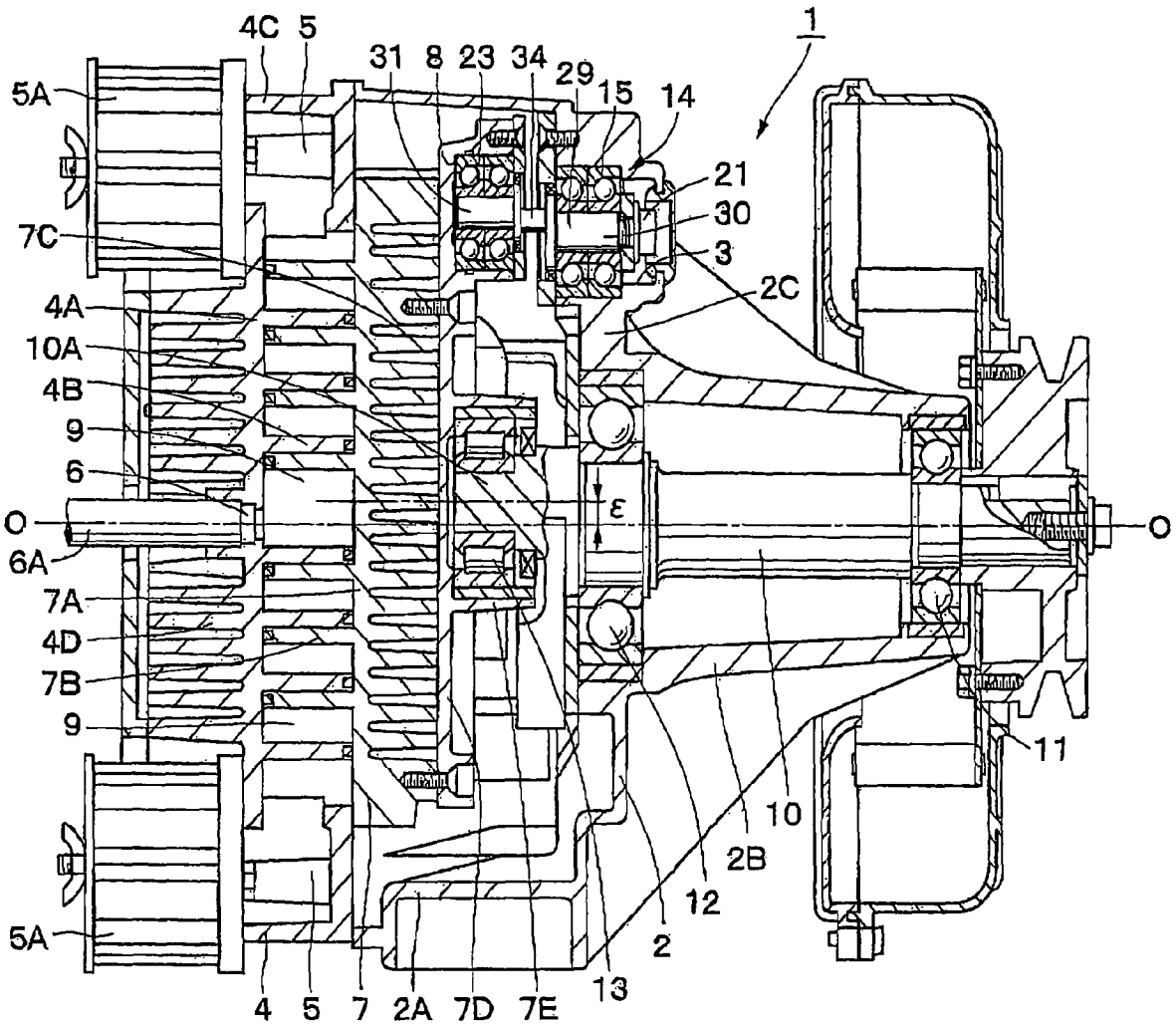
FIG. 1 is a longitudinal section of a scroll-type air compressor according to an embodiment of the present invention.
Figure 2:
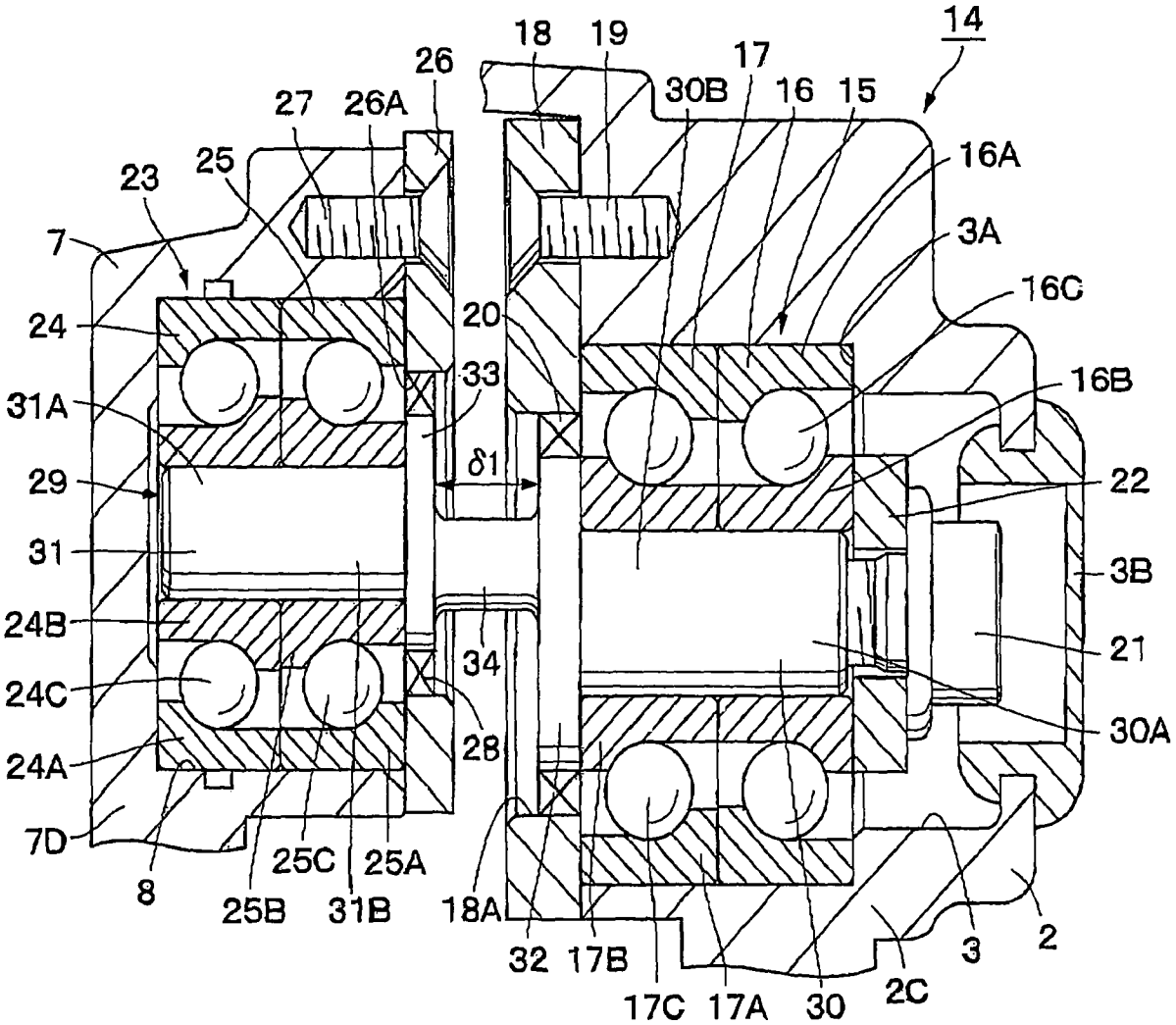
FIG. 2 is an expanded sectional-view expanding an auxiliary crank device of FIG. 1.
Figure 3:
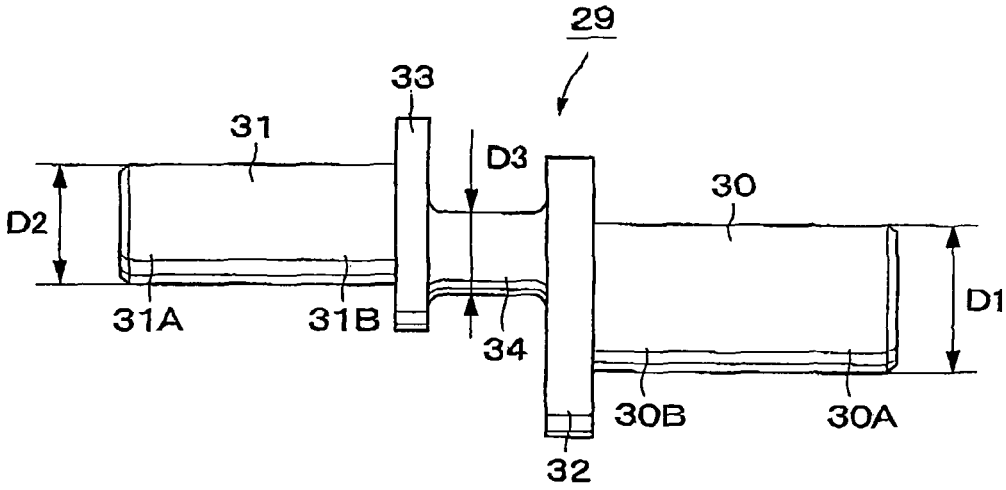
FIG. 3 is a front view showing an auxiliary crank shaft of FIG. 2.

First, FIGS. 1 to 3 show a first embodiment of the present invention. In FIG. 1, a reference numeral 1 is a scroll-type air compressor which compresses air. This scroll-type air compressor 1 generally comprises: a casing 2; a fixed scroll 4; an orbiting scroll 7; a driving shaft 10 and an auxiliary crank device 14 (details of those parts will be explained hereinafter).

A reference numeral 2 is the casing forming an outer frame of the scroll-type air compressor 1. One side of the casing 2 in its axial direction is nearly closed while the other side thereof is opened, so that the casing 2 is formed into a cylindrical body with a stepped portion. Further, the casing 2 generally comprises: a large diameter cylinder 2A; a small diameter cylinder 2B having a diameter less than the one of the large diameter cylinder 2A and being extended outside from one side of the large diameter cylinder 2A in its axial direction; and an annular portion 2C formed between the small diameter cylinder 2B and the large diameter cylinder 2A.

In addition, on an outer periphery side of the casing 2, a plurality of fixed-side bearing holders 3, for example, 3 (only 1 is shown), are provided at some circumferential spaces. Each of the bearing holders 3 is formed as a stepped circular cavity opened on the orbiting scroll 7 side (the open side), and is provided with a annular stepped portion 3A on the bottom portion side thereof, the annular stepped portion 3A having a hole diameter measurement less than the one of the open side. The bottom portion side of each of the bearing holders 3 is covered with a cover 3B. Each of the bearing holders 3 contains therein a casing-side ball bearing 15 of the auxiliary crank device 14 later explained.

A reference numeral 4 is the fixed scroll provided on the other side of the casing 2. This fixed scroll 4 is fixed at an opening end of the large diameter cylinder 2A so as to close the large diameter cylinder 2A of the casing 2 from the other side in the axial direction. The fixed scroll 4 generally comprises: an end plate 4A formed approximately into a circular-plate shape around an axis O-O; a spiral lap portion 4B standing on a surface of the end plate 4A in the axis direction; a cylindrical portion 4C provided on an outer peripheral side of the end plate 4A so as to surround the lap portion 4B; and a plurality of cooling fins 4D provided on a rear surface of the end plate 4A.

A reference numeral 5 is inlet ports (for example, a couple) provided on the fixed scroll 4. Each of the inlet ports 5 is opened from an outer peripheral side of the end plate 4A to the cylindrical portion 4C and communicated with a later-explained compression chamber 9 on the outer circumference side of the air compressor 1. The inlet ports 5 are for sending air into the compression chamber 9 on the outer circumference side of the air compressor 1 through a suction filter 5A.

A reference numeral 6 is an exhaust port provided on a central side of the end plate 4A of the fixed scroll 4 wherein the exhaust port 6 is communicated with the compression chamber 9 placed at the most center of air compressor 1. With the exhaust port 6, compressed air within the compression chamber 9 is exhausted outside through a discharge pipe 6A.

A reference numeral 7 is an orbiting scroll orbitably provided within the large diameter cylinder 2A of the casing 2, the orbiting scroll 7 facing the fixed scroll 4. This orbiting scroll 7 generally comprises: an approximately circularly-formed end plate 7A provided so as to face the end plate 4A of the fixed scroll 4; a spiral lap portion 7B standing on a surface of the end plate 7A; a plurality of cooling fins 7C proving on a rear surface of the end plate 7A; and a rear plate 7D fixed at a tip side of the cooling fins 7C.

Furthermore, a cylindrical boss portion 7E is integrally formed at the central portion of the rear plate 7D so as to rotatably connect with a later-explained crank 10A of the driving shaft 10. In addition, on the outer peripheral side of the rear plate 7D, orbiting-side bearing holders 8, for example 3 pieces (only one is shown), are provided at places corresponding to the fixed-side bearing holder 3. Each of the bearing holders 8 is formed with a closed-end circular cavity opened on the annular portion 2C side of the casing 2 and contains therein a scroll-side ball bearing 23 of the auxiliary crank device 14 later explained.

Reference numeral 9 is a plurality of compression chambers (fluid chambers) provided between the fixed scroll 4 and the orbiting scroll 7. These compression chambers 9 are shifted from the outer peripheral side of the lap portions 4B, 7B to the central side thereof according to the orbiting motion of the orbiting scroll 7 so as to sequentially reduce volume of the compression chambers 9. Accordingly, the compression chamber 9 of the most outer periphery side among the compression chambers 9 inhales air from the inlet port 5, and the air inhaled is to be compressed until the air reaches to the compression chamber 9 of the central side. Then, this compressed air is discharged from the exhaust port 6 and reserved in an air receiver (not shown), etc. placed outside through the discharge pipe 6A.

A reference numeral 10 is a driving shaft rotatably provided at the small diameter cylinder 2B of the casing 2 through bearings 11, 12. This driving shaft 10 is driven by a motor (not shown) and rotated around the axis O-O so as to move the orbiting scroll 7 in an orbital manner.

The other end side of the driving shaft 10 is provided with the crank 10A, which is decentered by a certain measure (eccentric amount of $\epsilon$) in a radius direction relative to the axis O-O. The crank 10A is rotatably connected with the boss portion 7E provided with the rear plate 7D of the orbiting scroll 7 through the orbiting bearing 13. Further, one end side of the driving shaft 10 is extended outside the casing 2 and connected with the output side of the motor through a band, etc. (not shown). The orbiting bearing 13 rotatably supports the orbiting scroll 7 at the crank 10A of the driving shaft 10.

Reference numeral 14 is a plurality of auxiliary crank devices, for example, 3 pieces (only one is shown), provided at some spaces in a circumferential direction between the annular portion 2C of the casing 2 and the orbiting scroll 7. Each of the auxiliary crank devices 14, as shown in FIG. 2, generally comprises; the later-explained casing-side ball bearing 15; the scroll-side ball bearing 23; and an auxiliary crank shaft 29. The auxiliary crank devices 14 are structured as a rotation prevention device in which to prevent rotation of the orbiting scroll 7.

Reference numeral 15 is a casing-side ball bearing as a fixed-side bearing body contained within the bearing holder 3 of the casing 2. In the casing-side ball bearing 15, a first angular ball bearing 16 placed on the bottom side of the bearing holder 3 and a second angular ball bearing 17 placed on the opening side of the bearing holder 3 are faced in a back-to-back manner so as to be formed into a back-combination angular ball bearing.

Here, the first angular ball bearing 16 comprises: an outer ring 16A placed outward in a radius direction; an inner ring 16B placed inward in a radius direction; and a plurality of steel balls 16C as a rolling element arranged between the outer ring 16A and the inner ring 16B. The second angular ball bearing 17, as nearly the same with the first angular ball bearing 16, comprises: an outer ring 17A; an inner ring 17B; and a plurality of steel balls 17C.

The outer rings 16A and 17A are press-fitted into the bearing holder 3 of the casing 2 in a condition not to be displaced both in the axial and radius directions. Further, the outer ring 16A is abutted against the annular stepped portion 3A on the bottom surface side of the bearing holder 3 while the outer ring 17A are abutted against a keep plate 18, whereby both of the outer rings 16A, 17A are fixed within the bearing holder 3 without being displaced. The inner rings 16B, 17B are pressurized by means of a bolt 21 later explained, and a fixed-side shank 30 is mounted on the both inner rings.

A reference numeral 18 is a keep plate provided on the opening side of the bearing holder 3. This keep plate 18 is provided with an insertion hole 18A at the center portion thereof so that the auxiliary crank shaft 29 can be inserted thereinto. The outer periphery of the keep plate 18 is fixed to the casing 2 with a bolt 19. Further, the outer ring 17A of the second angular ball bearing 17 is abutted against a portion adjacent to the insertion hole 18A of the keep plate 18, so that the casing-side ball bearing 15 is fixed within the bearing holder 3 without being displaced.

Between the keep plate 18 and the opening end surface of the bearing holder 3 of the casing 2, a slight clearance is formed so as to securely abut the keep plate 18 against the outer ring 17A of the casing-side ball bearing 15.

Based on the above architecture, the casing-side ball bearing 15 is fixed not to be displaced in the radius direction by means of the bearing holder 3 and also is fixed not to be displaced in the axial direction by means of the annular stepped portion 3A of the bearing holder 3 and the keep plate 18.

A reference numeral 20 is a seal member installed within the insertion hole 18A of the keep plate 18. This seal member 20 is slidably abutted against the outer periphery of a flange portion 32 of the auxiliary crank shaft 29, whereby the seal member 20 can prevent leakage of lubricant filled in between the outer rings 16A, 17A and the inner rings 16B, 17B of the casing-side ball bearing 15.

A reference numeral 21 is a bolt provided on the casing-side ball bearing 15 side and works as a fixed member along with a washer 22. This bolt 21 is screwed at the fixed-side shank 30 of the auxiliary crank shaft 29, and the washer 22 intervenes between the bolt 21 and the fixed-side shank 30. The washer 22 is abutted against the inner ring 16B of the casing-side ball bearing 15. Accordingly, by fastening the bolt 21, the inner rings 16B, 17B of the casing-side ball bearing 15 can be pressurized, whereby the fixed-side shank 30 of the auxiliary crank shaft 29 is fixed to the inner rings 16B, 17B.

A reference numeral 23 is a scroll-side ball bearing as an orbiting-side bearing body in which to be installed within the bearing holder 8 of the orbiting scroll 7. In this scroll-side ball bearing 23, a first angular ball bearing 24 placed on the bottom side of the bearing holder 8 and a second angular ball bearing 25 placed on the opening side of the bearing holder 8 are faced to each other so as to be formed into a front-combination angular ball bearing. That is, a bearing clearance between the angular ball bearings 24 and 25 becomes 0, whereby those ball bearings 24 and 25 are prevented from being displaced both in the radius and axial directions, thus securely supporting load.

Here, the first angular ball bearing 24 comprises: an outer ring 24A placed outward in a radius direction; an inner ring 24B placed inward in a radius direction; and a plurality of steel balls 24C as a rolling element arranged between the outer ring 24A and the inner ring 24B. The second angular ball bearing 25, as nearly the same with the first angular ball bearing 24, comprises: an outer ring 25A; an inner ring 25B; and a plurality of steel balls 25C.

The outer rings 24A and 25A are press-fitted into the bearing holder 8 of the orbiting scroll 7 in a condition not to be displaced both in the axial and radius directions. Further, the outer ring 24A is abutted against the bottom surface of the bearing holder 8 while the outer ring 25A are pressurized by means of a keep plate 26 later explained.

A reference numeral 26 is a keep plate provided on the opening side of the bearing holder 8, the keep plate working as a fixed member together with a bolt 27. This keep plate 26 is provided with an insertion hole 26A at the center thereof so that the auxiliary crank shaft 29 can be inserted thereinto. The outer periphery of the keep plate 26 is fixed to the orbiting scroll 7 with the bolt 27. Further, the outer ring 25A of the second angular ball bearing 25 is abutted against a portion adjacent to the insertion hole 26A of the keep plate 26. Accordingly, the keep plate 26 pressurizes the outer rings 24A, 25A of the scroll-side ball bearing 23 so as to fix the scroll-side ball bearing 23 within the bearing holder 8 without being displaced.

Between the keep plate 26 and the opening end surface of the bearing holder 8 of the orbiting scroll 7, a slight clearance is formed so as to securely pressurize the outer ring 25A of the scroll-side ball bearing 23 by means of the keep plate 26.

Based on the above architecture, the scroll-side ball bearing 23 is fixed not to be displaced in the radius direction by means of the bearing holder 8 and also is fixed not to be displaced in the axial direction by means of the bottom surface of the bearing holder 8 and the keep plate 26.

A reference numeral 28 is a seal member installed within the insertion hole 26A of the keep plate 26. This seal member 28 is slidably abutted against the outer periphery of a flange portion 33 of the auxiliary crank shaft 29, whereby the seal member 28 can prevent leakage of lubricant filled in between the outer rings 24A, 25A and the inner rings 24B, 25B of the scroll-side ball bearing 23.

A reference numeral 29 is an auxiliary crank shaft provided between the casing-side ball bearing 15 and the scroll-side ball bearing 23. This auxiliary crank shaft 29, as shown in FIGS. 2 and 3, comprises: the fixed-side shank 30 rotatably supported with the casing-side ball bearing 15; an orbiting-side shank 31 rotatably supported with the scroll-side ball bearing 23; the fixed-side flange portion 32 formed into a brimmed shape and provided on the basal side of the fixed-side shank 30; and the orbiting-side flange portion 33 formed into a brimmed shape and formed on the basal portion of the orbiting-side shank 31. Those flange portions 32, 33 are connected by means of a connecting portion 34.

Further, axes of both the fixed-side shank 30 and the orbiting-side shank 31 are each decentered, and an eccentric amount between the shanks 30 and 31 is set substantially identical with the eccentric amount $\epsilon$ of the driving shaft 10. Here, the fixed-side shank 30 and the orbiting-side shank 31 are both formed into a circular cylinder, and an outer diameter measurement D1 of the fixed-side shank 30 is set as a value larger than an outer diameter measurement D2 of the orbiting-side shank 31. Accordingly, the fixed-side shank 30 is formed into a circular cylinder with a large diameter, and the orbiting-side shank 31 is formed into a circular cylinder with a small diameter. Here, it is possible that the outer diameter measurement D1 of the fixed-side shank 30 is set as a value equal to or less than the outer diameter measurement D2 of the orbiting-side shank 31.

The fixed-side shank 30 is mounted at the inner rings 16B, 17B in such a manner that the bolt 21 is fastened, and the inner rings 16B, 17B of the casing-side ball bearing 15 are thus pinched with the washer 22 and the flange portion 32. Accordingly, a tip end portion 30A of the fixed-side shank 30 is arranged so as to face the inner ring 16B while a basal portion 30B of the fixed-side shank 30 is arranged so as to face the inner ring 17B. In addition, the outer rings 16A, 17A of the casing-side ball bearing 15 is fixed at the bearing holder 3 with the keep plate 18. The fixed-side shank 30 is thus installed in the casing-side ball bearing 15 in a condition not to be displaced both in the radius and axial directions.

On the other hand, the orbiting-side shank 31 is installed in the inner rings 24B, 25B of the scroll-side ball bearing 23 by press-fit, the orbiting-side shank 31 being in a condition not to be displaced both in the radius and axial directions. Accordingly, a tip end portion 31A of the orbiting-side shank 31 is arranged so as to face the inner ring 24B while a basal end portion 31B of the orbiting-side shank 31 is arranged so as to face the inner ring 25B. In addition, the outer rings 24A, 25A of the scroll-side ball bearing 23 are fixed at the bearing holder 8 with the keep plate 26. The orbiting-side shank 31 is thus installed in the scroll-side ball bearing 23 in a condition not to be displaced both in the radius and axial directions.

The fixed-side shank 30 is rotatably supported within the bearing holder 3 of the casing 2 through the casing-side ball bearing 15 while the orbiting-side shank 31 is rotatably supported within the bearing holder 8 on the orbiting-scroll 7 side through the scroll-side ball bearing 23. Accordingly, the auxiliary crank shaft 29 will prevent rotation of the orbiting-scroll 7 when the orbiting scroll 7 moves in an orbital manner along with rotational drive of the driving shaft 10.

The fixed-side flange portion 32 abuts against an axial end surface of the inner ring 17B of the casing-side ball bearing 15. Further, the orbiting-side flange portion 33 abuts an axial end surface of the inner ring 25B of the scroll-side ball bearing 23. Accordingly, in case that thrust load (thrust force) in the axial direction is applied to the orbiting scroll 7 due to pressure of the compression chamber 9, this thrust load will act on the orbiting-side flange portion 33 through the scroll-side ball bearing 23. Then, the thrust load having applied to the auxiliary crank shaft 29 will then act on the casing-side ball bearing 15 through the fixed-side flange portion 32 and will be finally held by the casing 2.

A reference numeral 34 is a connecting portion in which to connect the fixed-side shank 30 with the orbiting-side shank 31. This connecting portion 34 is placed between two pieces of the flange portions 32, 33. Further, the connecting portion 34 also comprises a deformative portion which allows the auxiliary crank shaft 29 to be deformed in the radius direction. To be more specific, the connecting portion 34 is formed, for example, into a circular cylinder having an outer diameter measurement D3 that is less than the outer diameter measurements D1, D2 of each of the shanks 30, 31. The connecting portion 34 is thus formed to be the thinnest relative to each of the shanks 30, 31, whereby the connecting portion 34 has lower rigidity in a radius direction compared to those of the shanks 30, 31. Based on this architecture, when centrifugal force of the orbiting scroll 7 is applied to the orbiting-side shank 31, the connecting portion 34 can be easily deformed on the fixed-side shank 30 as fulcrum.

The connecting portion 34 is axially arranged between the keep plate 18 on the casing 2 side and the keep plate 26 on the orbiting scroll 7 side. Accordingly, the outer periphery of the connecting portion 34 is not provided with any member restraining the connecting portion 34. The connecting portion 34 is formed with an axial clearance 6 between the flange portions 32, 33.

The scroll-type air compressor 1 according to the first embodiment is structured as discussed hereinabove. Operations thereof will be then explained.

First, by rotating the driving shaft 10 with an electric motor so as to move the orbiting scroll 7 in an orbital manner through the orbiting bearing 13, the compression chambers 9 formed between the lap portion 4B of the fixed scroll 4 and the lap portion 7B of the orbiting scroll 7 are sequentially contracted. Accordingly, outside air inhaled from the inlet port 5 is sequentially compressed in each of the compression chambers 9, and then exhaled from the exhaust port 6 as compressed air. The compressed air exhaled may be reserved within an air receiver, etc. placed outside.

While the inhaled air is compressed as discussed above, each of the auxiliary crank devices 14 will prevent rotation of the orbiting scroll 7 while the orbiting scroll 7 is moved in an orbital manner relative to the fixed scroll 4. Further, during the air compression, pressure in each of the compression chambers 9 will act on the orbiting scroll 7 as thrust load. This thrust load is held with three pieces of the auxiliary crank devices 14.

Figure 4:
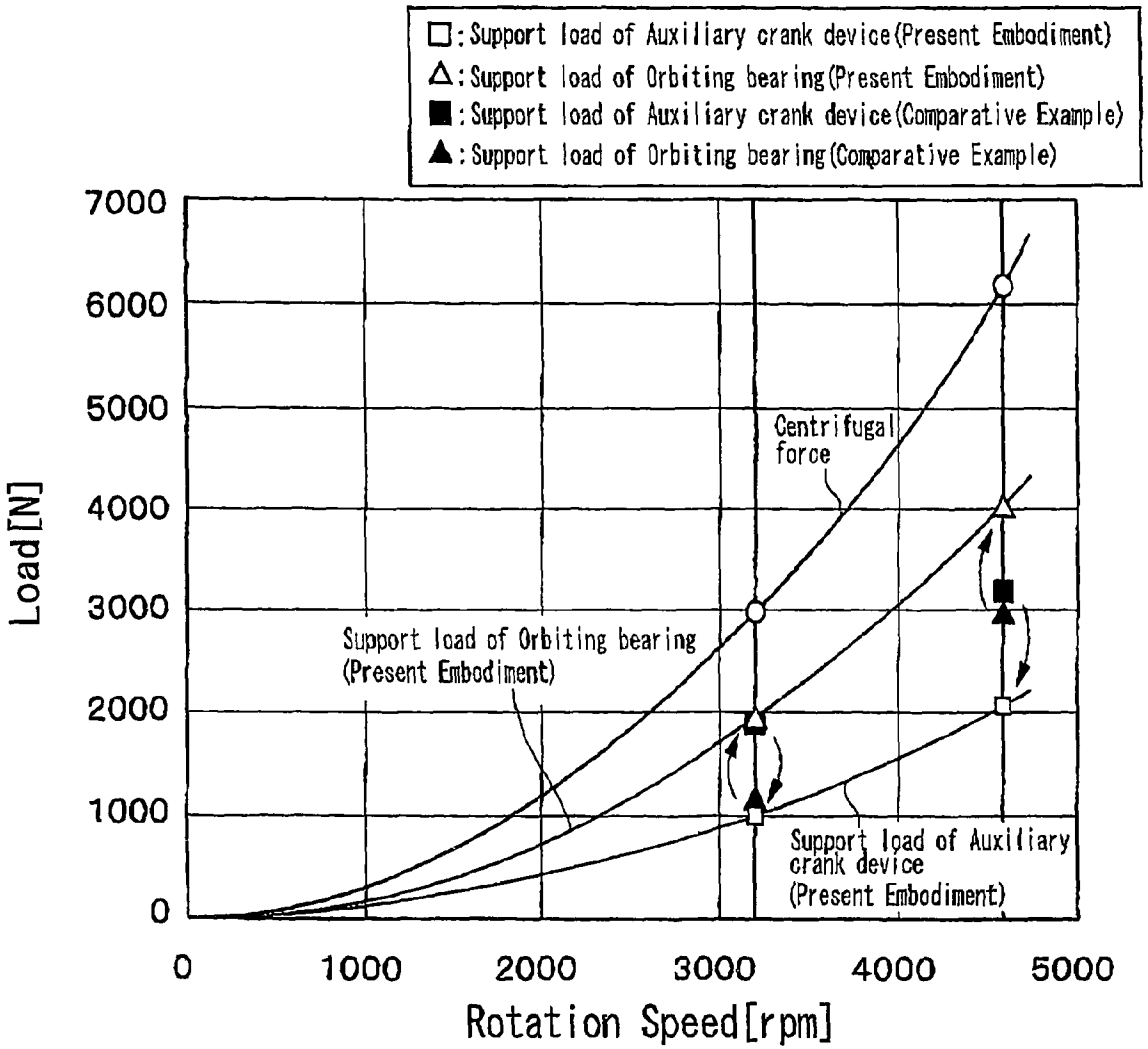
FIG. 4 is a characteristic diagram showing a relation between a revolving speed and centrifugal speed of an orbiting scroll, supporting load of an orbiting shaft as well as supporting load of the auxiliary crank device, according to the first embodiment.
Figure 5:
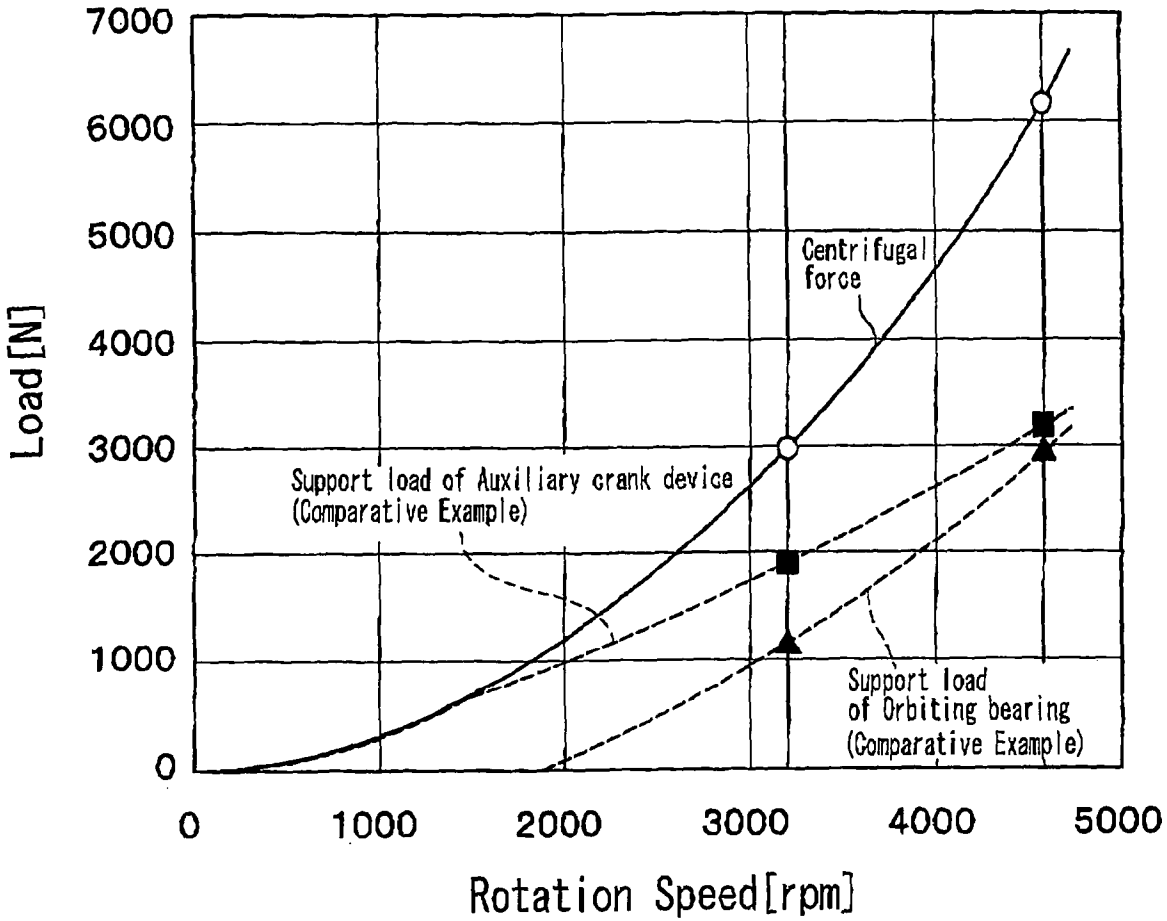
FIG. 5 is a characteristic diagram showing a relation between a revolving speed and centrifugal speed of an orbiting scroll, supporting load of an orbiting shaft as well as supporting load of the auxiliary crank device, according to a comparative example.

Along with the orbital movement of the orbiting scroll 7, centrifugal force will apply to the orbiting scroll 7. This centrifugal force will be held together with the orbiting bearing 13 and the auxiliary crank device 14. Here, supporting load applied to the orbiting bearing 13 and the auxiliary crank device 14 has been studied based on two cases: case (1) where rigidity of the connecting portion 34 is set low as shown in the first embodiment; and case (2) where rigidity of the connecting portion 34 is set high according to a comparative example. FIGS. 4 and 5 are the result of the above cases. In the comparative example, the outer diameter dimension D3 of the connecting portion 34 of the auxiliary crank shaft 29 is set larger than the outer diameter dimensions D1, D2 of each of the shanks 30, 31 so as to enhance the rigidity of the connecting portion 34.

As shown in FIG. 5, in the comparative example, the supporting load applied to the auxiliary crank device 14 becomes larger than the supporting load applied to the orbiting bearing 13. Further, if rotation speed of the driving shaft 10 is increased from 3,190 rpm to 4,600 rpm, the supporting load of the auxiliary crank device 14 will increase from 2,000 N to approximately 3,300 N. Accordingly, in case of the comparative example, the supporting load of the auxiliary crank device 14 becomes excessive, so that durability of the auxiliary crank device 14 may decrease.

On the contrary, in the first embodiment of the present invention, as shown in FIG. 4, the supporting load applied to the auxiliary crank device 14 becomes smaller than the supporting load applied to the orbiting bearing 13 as well as smaller than the case of the comparative example. This is why rigidity of the auxiliary crank shaft 29 in the radius direction is decreased due to the connecting portion 34 thereby making centrifugal force applied to the auxiliary crank device 14 reduced.

Accordingly, if rotation speed of the driving shaft 10 is set to 3,190 rpm, the supporting load of the auxiliary crank device 14 is decreased to approximately 1,000 N. Further, even if rotation speed of the driving shaft 10 is increased from 3,190 rpm (pre-accelerating speed) to 4,600 rpm (post-accelerating speed), the supporting load of the auxiliary crank device 14 can be reduced to the supporting load (around 2,000 N) approximately the same with the supporting load applied to the auxiliary crank device 14 where rotation speed of the driving shaft 10 is set to 3,190 rpm (conventional technologies or the comparative examples). With this architecture, it is possible to apply the ball bearings 15, 23, which have been used at the pre-accelerating speed, to the post-accelerating speed. Accordingly, it would be not necessary to enlarge the air compressor 1, whereby the air compressor for high-speed use can be manufactured at less cost. It would also be not necessary to enlarge the ball bearings 15, 23, and even if output of the air compressor 1 is increased due to a high-speed rotation, power consumption can be reduced so as to also cut energy consumption.

Here, the supporting load of the orbiting bearing 13 is, as shown in FIG. 4, enlarged compared to the comparative example, by an amount where the supporting load of the auxiliary crank device 14 is reduced. However, if the rotation speed of, for example, the driving shaft 10 is increased, sizes of the orbiting bearing 13, etc. become enlarged according to the rotation speed increased. Accordingly, durability of the orbiting bearing 13 appears not to be lowered, enabling to secure sufficient structural-reliabilities.

Based on the above, according to the first embodiment of the present invention, since the auxiliary crank shaft 29 is provided with the connecting portion 34 as the deformative portion, rigidity of the connecting portion 34 can be reduced thereby enabling to deform the auxiliary crank shaft 29 in the radius direction. Accordingly, even if centrifugal force is applied to the orbiting scroll 7, centrifugal force applied to the auxiliary crank device 14 can be reduced, whereby durability and structural-reliabilities of the auxiliary crank device 14 can be enhanced.

Considering disclosure of the patent document 1, in order to improve assembly of an orbiting scroll, O-ring is provided between an inner ring of an orbiting-side bearing body and a one-side shank of an auxiliary crank shaft. In this case, it may reduce centrifugal force of the orbiting scroll which acts on the orbiting-side bearing body due to the O-ring. However, a scroll-type fluid machine of the patent document 1 aims only to improve the assembly. Accordingly, after the orbiting scroll is installed into a driving shaft and the auxiliary crank shaft, the inner ring of the orbiting-side bearing body and the one-side shank of the auxiliary crank shaft are fastened with a machine screw. Based on this architecture, the inner ring of the orbiting-side bearing body and the one-side shank of the auxiliary crank shaft are structured as an integral structure, whereby centrifugal force of the orbiting scroll can not be absorbed by the O-ring, resulting in few reduction effect of the centrifugal force.

In the present invention, since the auxiliary crank shaft 29 is provided with the connecting portion 34 as the deformative portion allowing the connecting portion 34 to be deformed in the radius direction, the shanks 30, 31 formed as the same with the conventional shanks can be applied. Accordingly, it is possible to apply the ball bearings 15, 23 which have been used in the conventional technologies, contributing to miniaturization and low-cost of the air compressor 1. Further, there is no need to enlarge the ball bearings 15, 23, whereby power consumption can be reduced so as to also cut energy consumption.

Further, the connecting portion 34 of the auxiliary crank shaft 29 is formed as the deformative portion connecting the fixed-side shank 30 with the orbiting-side shank 31. Accordingly, it is possible to abut the flange portions 32, 33 of the auxiliary crank shaft 29 against the axial end surfaces of the inner rings 17B, 25B of the ball bearings 15, 23 so as to support thrust load. Also, since the axial clearance δ 1 is formed between the flange portions 32, 33 due to the connecting portion 34, the scroll-side ball bearing 23 will not contact with any member in a thrust direction even if the scroll-side shank 31 is displaced in the radius direction. With this architecture, fretting friction never occurs, thereby securing sufficient structural-reliabilities.

In the present invention, it is possible to apply the ball bearings 15, 23 identical with the conventional ball bearings, whereby rotational speed of the driving shaft 10 can be increased without substantial structural modifications and any size enlargement of present models. Accordingly, the air compressor 1 with large volume can be structured, contributing to miniaturization and low-cost.

Still further, since the connecting portion 34 is formed to be thinner than the fixed-side shank 30 and the orbiting-side shank 31, rigidity of the connecting portion 34 in the radius direction can be reduced compared to the those shanks 30, 31. Accordingly, in case that centrifugal force of the orbiting scroll 7 is applied to the orbiting-side shank 31, the connecting portion 34 can be easily deformed on the fixed-side shank 30 as fulcrum.

Figure 6:
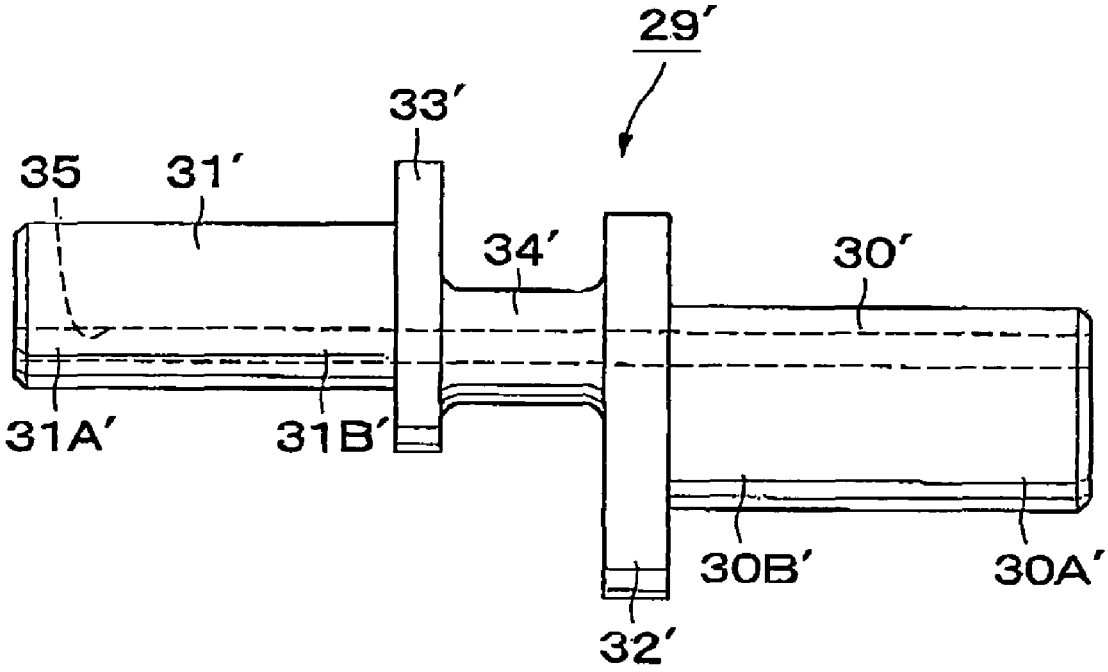
FIG. 6 is a front view showing a modified auxiliary crank shaft.

In the first embodiment of the present invention, the fixed-side shank 30, the orbiting-side shank 31 and the connecting portion 34 of the auxiliary crank shaft 29 are all formed as a solid structure. However, the present invention is not limited to this structure. For example, like a first modified example as shown in FIG. 6, an auxiliary crank shaft 29' may be structured as that a through hole 35 axially penetrating through a fixed-side shank 30', an orbiting-side shank 31', and a connecting portion 34' may be provided. Here, the interior of the connecting portion 34' may be formed as a hollow structure. In this case, rigidity of the auxiliary crank shaft 29' in the radius direction can be further reduced. Note that it is preferable that the central axis of the through hole 35 and the central axis of the connecting portion 34' with less rigidity are made correspondent with each other.

Still further, in the first embodiment of the present invention, the deformative portion allowing of deformation in the radius direction is provided at the connecting portion 34 connecting between the fixed-side shank 30 and the orbiting-side shank 31. However, the present invention is not limited to this structure. That is, the deformative portion may be provided at any portion between the tip end portion 30A of the fixed-side shank 30 and the tip end portion 31A of the orbiting-side shank 31. The deformative portion may be provided at the basal portion of the fixed-side shank or the basal portion of the orbiting-side shank.

Hereinafter, some modified examples of the present invention will be briefly explained. Although reference numerals are omitted, structures of shown parts are substantially the same with those of the first embodiments except for any modification specifically described hereinbelow.

An unconstraint portion allowed to be displaced in the radius direction may be provided at the basal portion of the orbiting-side shank of the auxiliary crank shaft. In this case, a brim-shaped intermediate flange portion is formed at an axial intermediate portion of the orbiting-side shank. The tip end portion of the orbiting-side shank is placed at further tip end side relative to the intermediate flange portion in the axial direction, and installed into the inner ring of the scroll-side ball bearing through interference fit or transition fit.

Further, the unconstraint portion of the present invention may be formed into a circular cylinder having an outer diameter dimension less than an outer diameter dimension of both the fixed-side shank and the tip end portion of the orbiting-side shank.

In the auxiliary crank shaft, it is possible to provide a through hole with the orbiting-side shank, the through hole being extended in the axial direction. The interior of the unconstraint portion, in this case, may be formed as a hollow structure. With this architecture, rigidity of the orbiting-side shank in the radius direction may be further reduced.

Here, the unconstraint portion of the auxiliary crank shaft may be formed with materials more flexible than other parts such as the shanks. Still in this case, rigidity of the orbiting-side shank in the radius direction can be further reduced.

In addition, the scroll-side ball bearing may have a plurality of ball bearings with inner diameters different from each other, and the unconstraint portion may be arranged so as to face an inside of the ball bearing(s) with the inner diameters larger than the others. In this case, a spacer is sandwiched between these inner rings in the axial direction. Since pressure of the keep plate acts on the inner rings through the outer rings and steel balls, the inner rings can be integrally rotated.

Needless to say, those modified embodiments discussed hereinabove can also achieve approximately the same functional effects with the first embodiment.

Next, a second embodiment of the present invention will be explained with reference to FIGS. 7 to 10. The features of the second embodiment are to provide a closed-end, cylindrical cap member between an inner ring of a scroll-side ball bearing and an orbiting-side shank of an auxiliary crank shaft, and to arrange an unconstraint portion of the orbiting-side shank inside the cap member. Here, in the second embodiment, any components identical with or corresponding to those of the aforementioned first embodiment are denoted by the same reference numerals, and a detailed description thereof will be omitted below.

A reference numeral 81 is an auxiliary crank device according to the second embodiment. This auxiliary crank device 81 comprises: the casing-side ball bearing 15, the scroll-side ball bearing 23, a cap member 82, an auxiliary crank shaft 83, and the like.

A reference numeral 82 is a closed-end, cylindrical cap member in which to be inserted into the inner rings 24B, 25B of the scroll-side ball bearing 23. This cap member 82 comprises: a disk-like bottom portion 82A; a cylindrical portion 82B axially extended from the bottom portion 82A; a brimmed portion 82C provided on an opening side of the cylindrical portion 82B and extended outside in the radius direction. The cap member 82 is press-fitted into the inner rings 24B, 25B and rotated with the inner rings 24B, 25B in an integral manner. Further, the cylindrical portion 82B of the cap member 82 may have an outer diameter dimension D11 less than an outer diameter dimension D10 of a fixed-side shank 84 of the auxiliary crank shaft 83 later explained. Here, the outer diameter dimension D11 of the cylindrical portion 82B of the cap member 82 may be set equal to or larger than the outer diameter dimension D10 of the fixed-side shank 84.

An interior of the cap member 82 is provided with: a small-diameter cavity 82D having a hole diameter measurement less than an outer diameter dimension D12 of an orbiting-side shank 85 of the auxiliary crank shaft 83; and a large-diameter cavity 82E having a hole diameter dimension larger than the outer diameter dimension D12 of the orbiting-side shank 85. In this case, the small-diameter cavity 82D is arranged on the bottom portion 82A side of the cap member 82 while the large-diameter cavity 82E is arranged on the opening side (the brimmed portion 82C side) of the cap member 82. With this architecture, the cap member 82 is provided with a stepped cavity composed of the small-diameter cavity 82D and the large-diameter cavity 82E.

Further, the large-diameter cavity 82E is extended from the opening portion side to the bottom portion side of the cap member 82. A tip of the large-diameter cavity 82E is axially extended up to some place of the inner ring 25B of the second angular ball bearing 25. Accordingly, the small-diameter cavity 82D faces both of the inner rings 24B, 25B in the radius direction while the large-diameter portion 82E only faces the inner ring 25B in the radius direction.

Still further, the brimmed portion 82C is abutted against the axial end surface of the inner ring 25B. With this architecture, in case that thrust load is applied to the orbiting scroll 7, the thrust load will act on the brimmed portion 82C of the cap member 82 through the scroll-side ball bearing 23. Here, the seal member 28 is installed between the brimmed portion 82C and the insertion hole 26A of the keep plate 26 so as to prevent lubricant of the scroll-side ball bearing 26 from being leaked.

A reference numeral 83 is an auxiliary crank shaft provided between the casing-side ball bearing 15 and the scroll-side ball bearing 23. This auxiliary crank shaft 83 comprises: the fixed-side shank 84 rotatably supported with the casing-side ball bearing 15; the orbiting-side shank 85 rotatably supported with the scroll-side ball bearing 23 through the cap member 82; and a fixed-side flange portion 86 provided on the basal end of the fixed-side shank 84, the flange portion 86 being formed into a brimmed shape.

Here, the fixed-side shank 84 and the orbiting-side shank 85 are each decentered by an eccentric amount substantially identical with the driving shaft 10. Further, the orbiting-side shank 85 and the flange portion 86 are connected with each other by means of a large-diameter connecting portion 87 with high rigidity.

The orbiting-side shank 85 is formed into a circular cylinder linearly extended and has the outer diameter dimension D12, which is identical through the overall length thereof. In this case, the outer diameter dimension of the orbiting-side shank 85 is formed to be less than the hole diameter dimension of the large-diameter cavity 82E, for example, nearly identical with the hole diameter dimension of the small-diameter cavity 82D. With this architecture, the orbiting-side shank 85 can be inserted into the cap member 82.

The orbiting-side shank 85 is then installed into the small-diameter cavity 82D of the cap member 82 through interference fit. Accordingly, the small-diameter cavity 82D is structured as a constraint cavity in which to hold the orbiting-side shank 85. On the other hand, the orbiting-side shank 85 is installed into the large-diameter cavity 82E of the cap member 82 through clearance fit. Thus, the large-diameter cavity 82E is structured as an unconstraint cavity in which not to hold the orbiting-side shank 85.

Here, the bolt 21 is fastened so as to pinch the inner rings 16B, 17B of the casing-side ball bearing 15 between the washer 22 and the flange portion 86. With this architecture, the fixed-side shank 84 is installed into the inner rings 16B, 17B. Accordingly, a tip end portion 84A of the fixed-side shank 84 is arranged so as to face the inner ring 16B while a basal portion 84B of the fixed-side shank 84 is arranged so as to face the inner ring 17B. The fixed-side shank 84 is thus installed into the casing-side ball bearing 15 in a condition not to be displaced both in the radius and axial directions.

On the other hand, a tip end portion 85A of the orbiting-side shank 85 is installed into the small-diameter cavity 82D of the cap member 82 through interference fit such as press-fit. Further, the cap member 82 is press-fitted into the inner rings 24B, 25B of the scroll-side ball bearing 23. Accordingly, the tip end portion 85A of the orbiting-side shank 85 is installed into the scroll-side ball bearing 23 in a condition not to be displaced both in the radius and the axial directions. The tip end portion 85A of the orbiting-side shank 85 is thus not shaken in the radius direction whereby it can support centrifugal force of the orbiting scroll 7 by means of the first and second angular ball bearings 24, 25.

Figure 10:
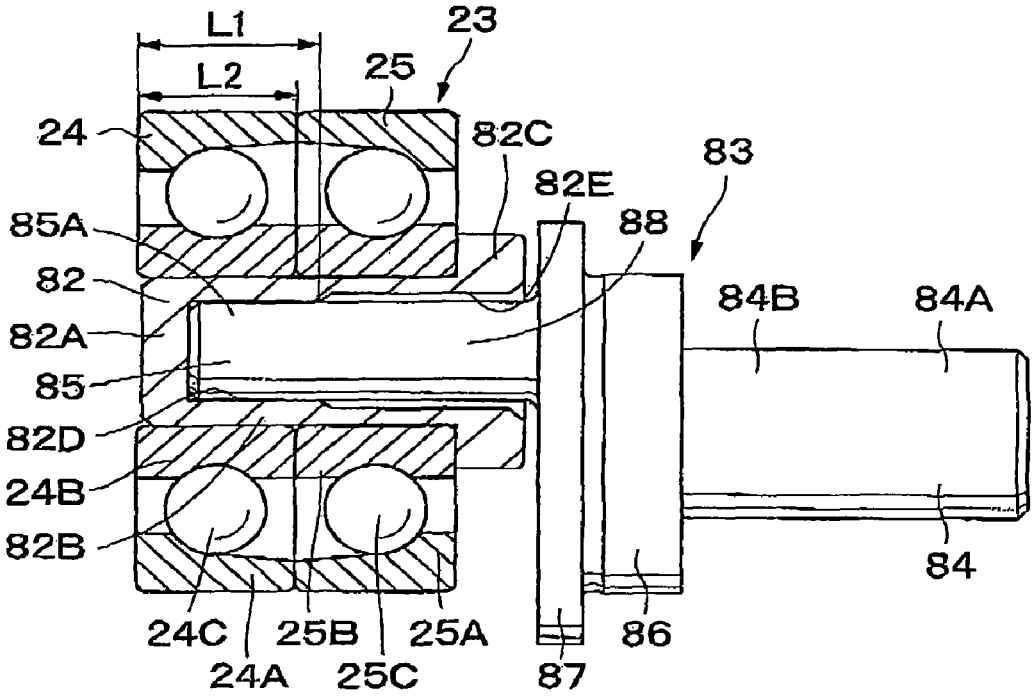
FIG. 10 is a front view showing a state where the auxiliary crank shaft and the cap member of FIG. 7 are installed into a scroll-side ball bearing.

Further, the small-diameter cavity 82D of the cap member 82 is extended to some places in which to face both the inner ring 24B and the inner ring 25B. That is, in a condition where the brimmed portion 82C of the cap member 82 is abutted against the inner ring 25B of the second angular ball bearing 25, as shown in FIG. 10, length L1 is set to be larger than length L2, the length L2 defining as an axial length of the first angular ball bearing 24. In more details, the length L1 can be defined as length which starts from the bottom end surface of the bearing holder 8 of the first angular ball bearing 24 to the tip of the small-diameter cavity 82D (the opening side of the bearing holder 8).

Based on the above, when the tip end portion 85A of the orbiting-side shank 85 is installed into the small-diameter cavity 82D, the periphery of the small-diameter cavity 82D in the cap member 82 will be solid, whereby the external periphery of the cap member 82 is securely abutted against the inner rings 24B, 25B. Accordingly, there occurs no shaking between the cap member 82 and the inner rings 24B, 25B, whereby the cap member 82 and the inner rings 24B, 25B can be rotated in an integral manner.

Figure 7:
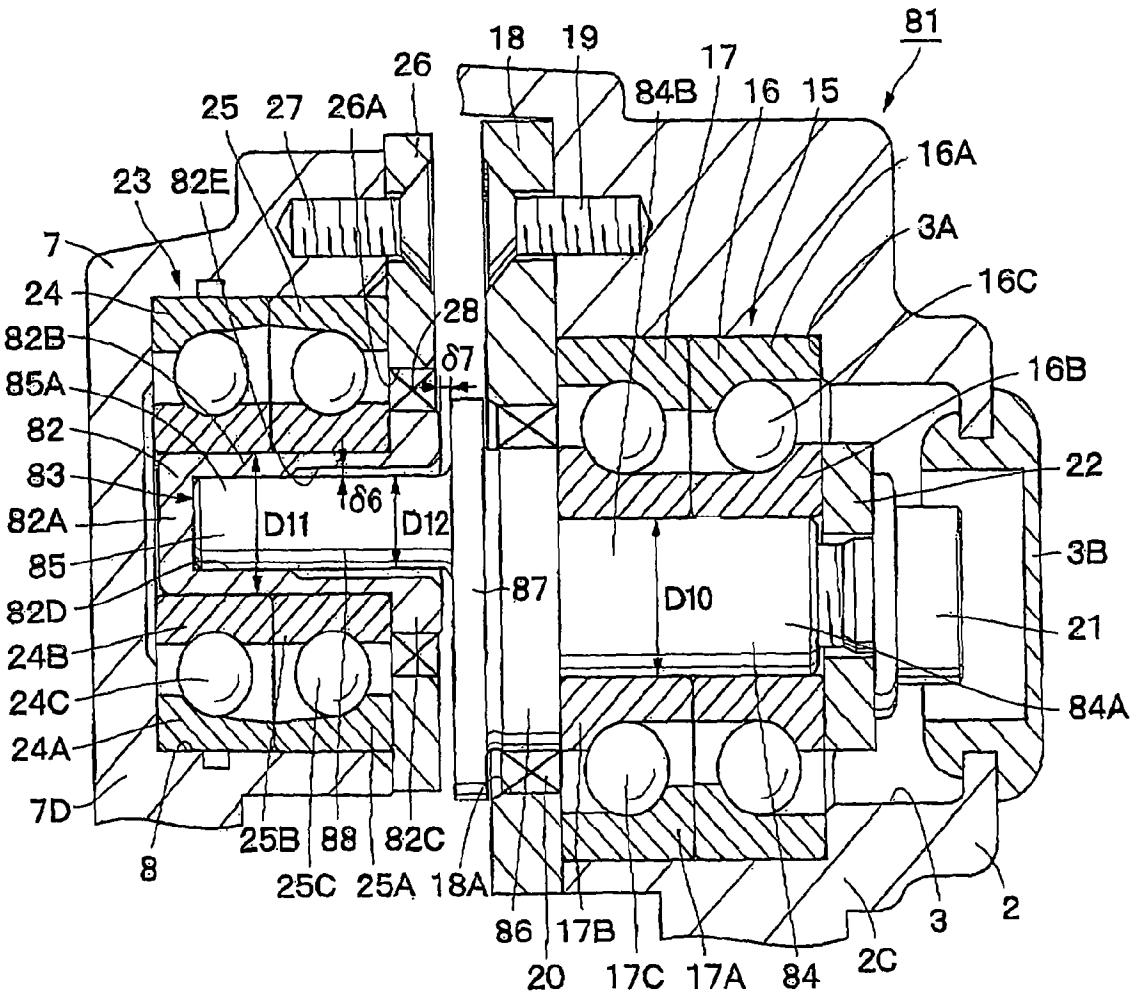
FIG. 7 is an expanded sectional-view expanding an auxiliary crank device according to a second embodiment.
Figure 8:
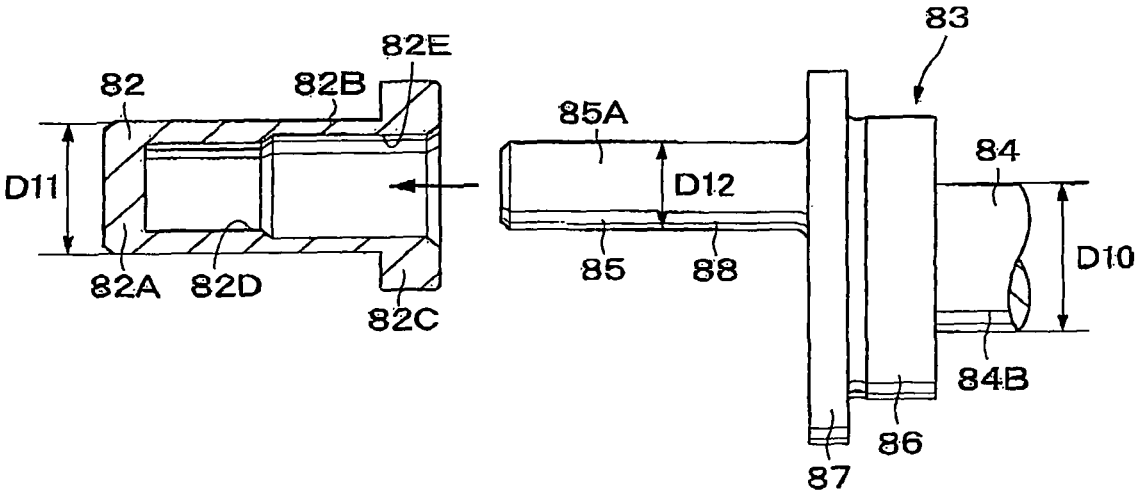
FIG. 8 is a front view showing an assembling state of an auxiliary crank shaft and a cap member of FIG. 7.
Figure 9:
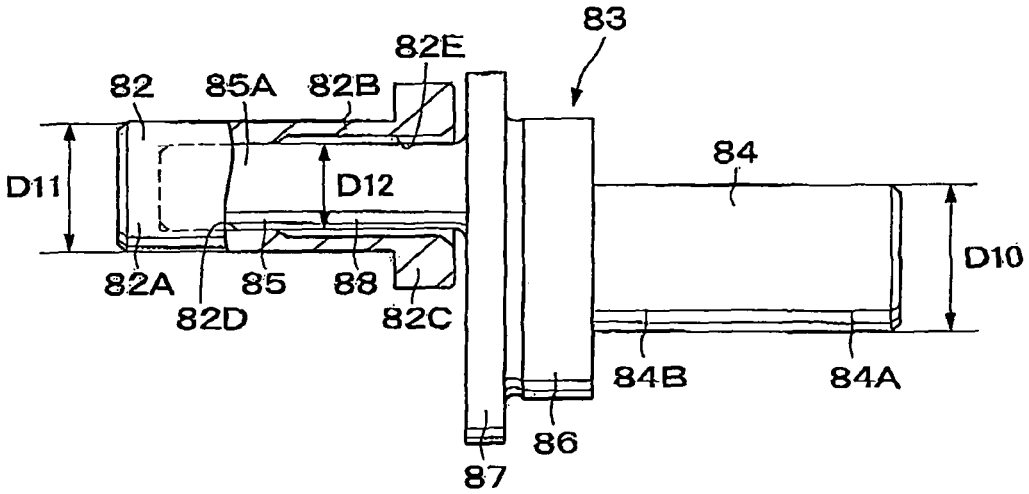
FIG. 9 is a partially-cutaway front view showing an assembled state of the auxiliary crank shaft and the cap member of FIG. 7.

As shown in FIG. 7, the fixed-side shank 84 is rotatably supported within the bearing holder 3 of the casing 2 through the casing-side ball bearing 15 while the orbiting-side shank 85 is rotatably supported within the bearing holder 8 on the orbiting scroll 7 side through the cap member 82 and the scroll-side ball bearing 23. With this architecture, the auxiliary crank shaft 83 will prevent the orbiting scroll 7 from being rotated when the orbiting scroll 7 is moved in an orbital manner by rotational drive of the driving shaft 10.

The fixed-side flange portion 86 is abutted against the axial end surface of the inner ring 17B of the casing-side ball bearing 15. Further, the tip of the orbiting-side shank 85 is abutted against the bottom portion 82A of the cap member 82. Accordingly, in case that axial thrust load (thrust force) is applied to the orbiting scroll 7 due to pressure of the compression chamber 9, this thrust load will act on the orbiting-side shank 85 of the auxiliary crank shaft 83 through the scroll-side ball bearing 23 and the cap member 82. Further, the thrust load acted on the auxiliary crank shaft 83 will affect to the casing-side ball bearing 15 through the fixed-side flange portion 86 and will finally be held by the casing 2.

A reference numeral 88 is an unconstraint portion provided on the basal portion side (the large-diameter connecting portion 87 side) of the orbiting-side shank 85. This unconstraint portion 88 is axially extended to the mid-place of the orbiting-side shank 85, that is, arranged between the tip end portion 85A and the large-diameter connecting portion 87. Note that the unconstraint portion 88 is arranged at some place only facing the second angular ball bearing 25.

Further, the unconstraint portion 88 is arranged so as to face the large-diameter cavity 82E in the stepped cavity of the cap member 82, and a circumferential clearance δ 6 is formed between the unconstraint portion 88 and the large-diameter cavity 82E so as to surround the unconstraint portion 88. With this clearance δ 6 provided in the radius direction, the unconstraint portion 88 is arranged in the scroll-side ball bearing 23 in a unconstraint condition, that is, not abutted against an inner wall of the cap member 82.

Still further, the unconstraint portion 88 has an axial length measurement larger than the one of the large-diameter cavity 82E. That is, the overall length of the orbiting-side shank 85 is formed to be longer than a depth measurement of the entire stepped cavity which is formed by the small-diameter cavity 82D and the large-diameter cavity 82E of the cap member 82. With this architecture, between the brimmed portion 82C of the cap member 82 and the large-diameter connecting portion 87 of the auxiliary crank shaft 83, an axial clearance δ 7 is formed so as not to make the brimmed portion 82C and the large-diameter connecting portion 87 slidably abutted to each other. This clearance δ 7 prevents the brimmed portion 82C and the large-diameter connecting portion 87 from being slidably displaced, and also prevents occurrence of fretting friction.

The unconstraint portion 88 is a part of the orbiting-side shank 85, which is linearly extended. Accordingly, for example, the unconstraint portion 88 may be formed into a cylinder having the outer diameter dimension D12 which is less than both the outer diameter dimension D10 of the fixed-side shank 84 and the outer diameter dimension D11 of the cap member 82. With this architecture, the unconstraint portion 88 is formed to be thinner than the cap member 82 contributing to low rigidity in the radius direction. Then, in case that centrifugal force of the orbiting scroll 7 is applied to the unconstraint portion 88, the unconstraint portion 88 can be easily deformed on the large-diameter connecting portion 87 as fulcrum. Accordingly, with the unconstraint portion 88, the tip end portion 85A of the orbiting-side shank 85 can be supported in a condition shiftable in the radius direction.

Here, the second embodiment of the present invention as discussed above can gain functional effects substantially identical with the first embodiment. In the second embodiment, however, the closed-end, cylindrical cap member 82 is provided between the inner rings 24B, 25B of the scroll-side ball bearing 23 and the orbiting-side shank 85 of the auxiliary crank shaft 83. Furthermore, the unconstraint portion 88 of the orbiting-side shank 85 is arranged inside the cap member 82. With these architectures in the second embodiment, without modifying conventional scroll-side ball bearings, by simply exchanging a cap member and an auxiliary crank shaft, the air compressor 1 applicable for high-speed rotation can be structured.

Still further, since the cap member 82 is provided with the stepped cavity composed of the small-diameter cavity 82D and the large-diameter cavity 82E, the orbiting-side shank 85 of the auxiliary crank shaft 83 can be formed linearly, whereby formations of the auxiliary crank shaft 83 can be simplified, contributing to advancement of workability and productivity.

Moreover, the unconstraint portion 88 is arranged so as to face an inside of only the second angular ball bearing 25 among the first and second angular ball bearings 24, 25. Here, the small-diameter cavity 82D of the cap member 82 is axially arranged from the inner ring 24B to some place facing the inner ring 25B. The tip end portion 85A of the orbiting-side shank 85 will be then inserted into the small-diameter cavity 82D. Accordingly, since the circumference of the small-diameter cavity 82D in the cap member 82 becomes solid, the outer periphery of the cap member 82 can be securely abutted against the inner rings 24B, 25B. Any shaking between the cap member 82 and the inner rings 24B, 25B thus does not occur, whereby the cap member 82 and the inner rings 24B, 25B can be rotated in an integral manner.

Here, around the unconstraint portion 88 in the cap member 82, rigidity tends to be reduced, whereby pressure applied to the second angular ball bearing 25 may be lowered. However, in the second embodiment, since the small-diameter cavity 82D is axially arranged up to some place facing the inner ring 25B, by inserting the orbiting-side shank 85 into the small-diameter cavity 82D, sufficient pressure can be given both to the first and second angular ball bearings 24, 25. Based on the above, there is no case that the orbiting scroll 7 is axially displaced due to deficiency of pressure, whereby, for example, thrust clearance between the lap portions 4B, 7B and the end plates 7A, 4A can be constantly maintained.

In the second embodiment, the orbiting-side shank 85 of the auxiliary crank shaft 83 is formed into the circular cylinder having the outer diameter dimension D12 which is identical through the overall length. Further, the cap member 82 is provided with the small-diameter cavity 82D and the large-diameter cavity 82E. The orbiting-side shank 85 is inserted into the small-diameter cavity 82D, and the unconstraint portion 88 is formed so as to only face the large-diameter cavity 82E.

However, the present invention is not limited to the above-discussed embodiments, but the orbiting-side shank of the auxiliary crank shaft may be provided with a large-diameter shank at the tip side thereof, the large-diameter shank having an outer diameter dimension larger than a small-diameter shank placed on the basal portion side of the orbiting-side shank. Moreover, the cap member may be formed with a cavity having a bore diameter dimension (through the overall length in the depth direction) equal to or less than the outer diameter dimension of the large-diameter shank of the orbiting-side shank. In this case, by inserting the orbiting-side shank into the cavity, the unconstraint portion is formed so as to face the small-diameter shank.

Figure 11:
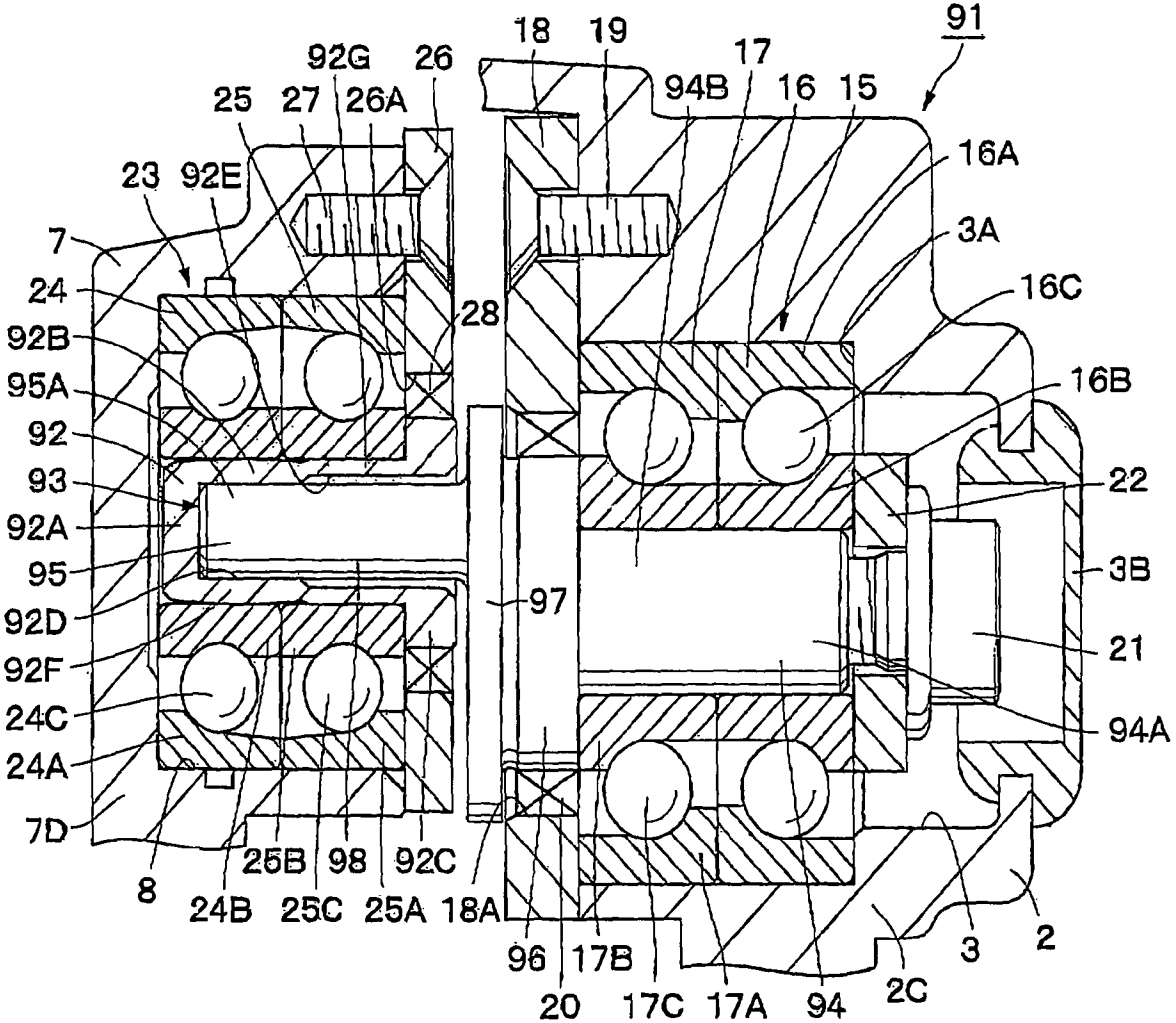
FIG. 11 is an expanded sectional-view expanding an auxiliary crank device according to a third embodiment.

Next, the third embodiment of the present invention will be explained with reference to FIGS. 11 to 13. In this embodiment, a cap member comprises: a small-diameter cavity provided on a bottom portion side of the cap member and having a bore diameter dimension equal to or less than an outer diameter dimension of an orbiting-side shank; a large-diameter cavity provided on an opening side of the cap member and having a bore diameter dimension larger than the outer diameter dimension of the orbiting-side shank; a small-diameter cylindrical portion placed on the outer periphery side of the small-diameter cavity; and a large-diameter cylindrical portion placed on the outer periphery side of the large-diameter cavity. The outer diameter dimension of the small-diameter cavity is less than the one of the large-diameter cavity. Hereinafter, the details of the third embodiment will be explained, and the same components as those of the first embodiment will be designated with the same reference numerals and the explanations thereof will be thus omitted.

A reference numeral 91 is an auxiliary crank device according to the third embodiment. This auxiliary crank device 91 comprises: the casing-side ball bearing 15; the scroll-side ball bearing 23; a cap member 92; an auxiliary crank shaft 93; and the like.

A reference numeral 92 is a closed-end, cylindrical cap member in which to be inserted into the inner rings 24B, 25B of the scroll-side ball bearing 23. This cap member 92, as the same with the cap member 82 in the second embodiment, comprises: a bottom portion 92A; a cylindrical portion 92B; and a brimmed portion 92C. Further, the interior of the cap member 92 is formed with, as the same with the small-diameter cavity 82D and the large diameter cavity 82E of the cap member 82, a stepped cavity composed of a small-diameter cavity 92D and a large-diameter cavity 92E. The cap member 92 is press-fitted into the inner rings 24B, 25B and rotated with the inner rings 24B, 25B in an integral manner.

The cap member 92 is, however, different from the cap member 82 according to the second embodiment in that the cap member 92 has its outer periphery formed into a stepped configuration. To be more specific, the cap member 92 comprises: a small-diameter cylindrical portion 92F provided on the outer periphery of the small-diameter cavity 92D; and a large-diameter cylindrical portion 92G provided on the outer periphery of the large-diameter cavity 92E. The small-diameter cylindrical portion 92F has an outer diameter dimension D13 which is less in the radius direction than the large-diameter cylindrical portion 92G having an outer diameter dimension D14.

Figure 12:
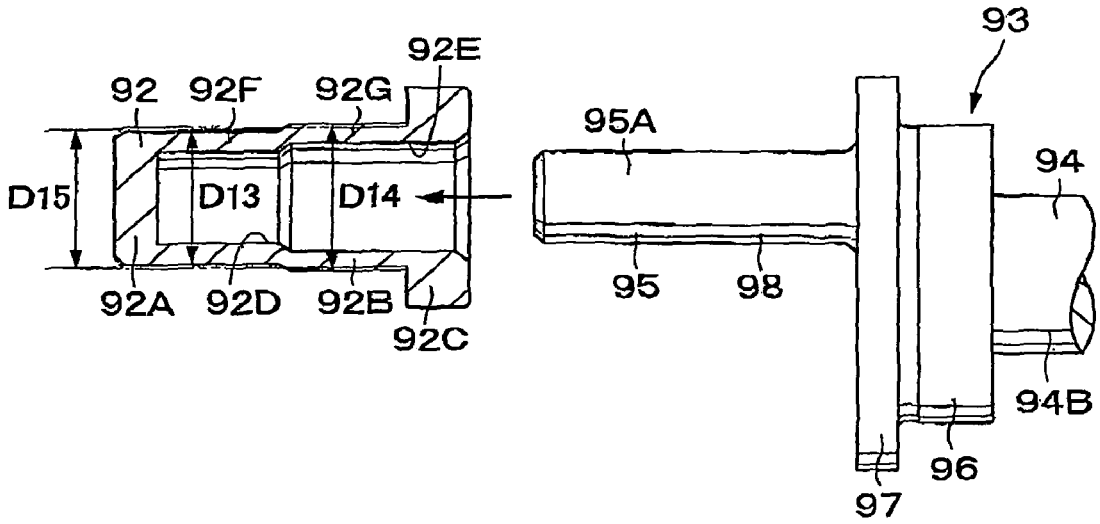
FIG. 12 is a front view showing an assembling state of an auxiliary crank shaft and a cap member of FIG. 11.
Figure 13:
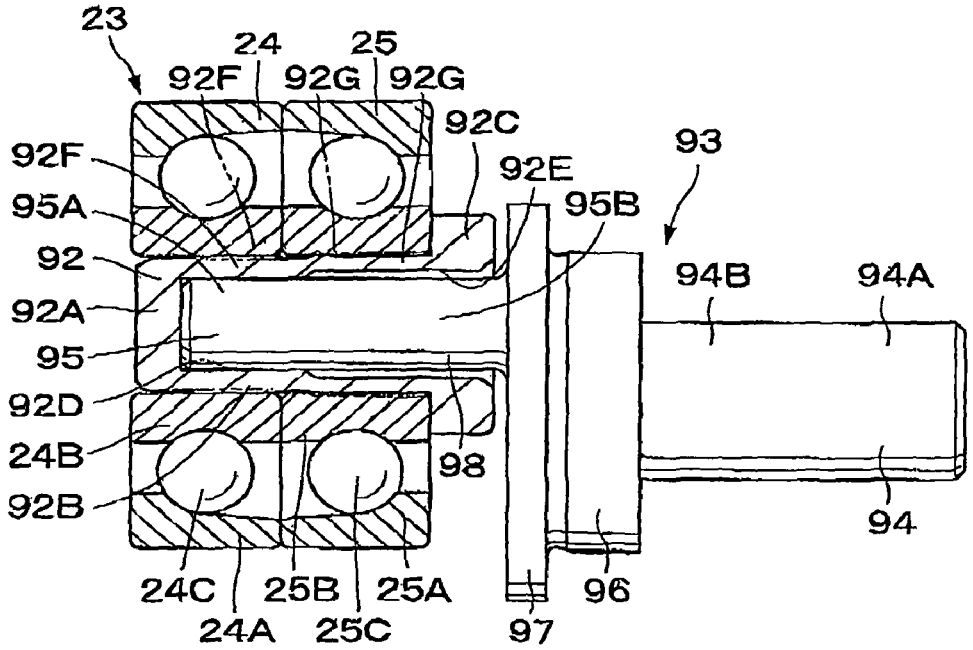
FIG. 13 is a front view showing a state where the auxiliary crank shaft and the cap member of FIG. 11 are installed into a scroll-side ball bearing.

In general, an outer diameter dimension D15 inserted into the inner ring 24B is slightly larger than the inner diameter dimension of the inner ring 24B, as indicated by the alternate long and two short dashes line in FIG. 12. The outer diameter dimension D15 will be thus determined depending on interference relative to the inner ring 24B. Here, the outer diameter dimension D15 may be equal to, for example, the outer diameter dimension of the orbiting-side shank 31 according to the first embodiment.

On the contrary, the outer diameter dimension D13 of the small-diameter cylindrical portion 92F is set less than the outer diameter dimension D15. In this case, ΔD13 defined by the difference between the outer diameter dimension D13 and the outer diameter dimension D15 should be determined in consideration of that the small-diameter cylindrical portion 92F may be expanded in the radius direction when an orbiting-side shank 95 later explained is inserted into the small-diameter cavity 92D. Accordingly, the ΔD13 is set approximately to 1/1000 of the outer diameter measurement D15 at its maximum. To be more specific, when the outer diameter measurement D15 is 12 mm, the ΔD13 is set equal to or less than 10 μm.

On the other hand, the outer diameter dimension D14 of the large-diameter cylindrical portion 92G is set larger than the outer diameter dimension D15. In this case, ΔD14 defined by the difference between the outer diameter dimension D14 and the outer diameter dimension D15 should be determined in consideration of the following. When the large-diameter cylindrical portion 92G is inserted into the inner ring 25B, the large-diameter cylindrical portion 92G can be deformed toward the interior side of the cylindrical portion due to the unconstraint portion 98, unlike the small-diameter cylindrical portion 92F. Pressure applied to the inner ring 25B will be thus reduced. Accordingly, the ΔD14 is set approximately to 1/1000 of the outer diameter dimension D15 at its maximum. To be more specific, in case that the outer diameter dimension D15 is set to 12 mm, the ΔD14 is set equal to or less than 10 μm.

A referential numeral 93 is an auxiliary crank shaft provided between the casing-side ball bearing 15 and the scroll-side ball bearing 23. This auxiliary crank shaft 93 is formed as the same manner with the auxiliary crank shaft 83 according to the second embodiment of the present invention, and comprises: an fixed-side shank 94; an orbiting-side shank 95; flange portion 96; and a large-diameter connecting portion 97. In this case, a tip end portion 94A of the fixed-side shank 94 is arranged so as to face the inner ring 16B while a basal portion 94B of the fixed-side shank 94 is arranged so as to face the inner ring 17B.

The orbiting-side shank 95 is installed into the small-diameter cavity 92D of the cap member 92 through, for example, press-fit. Here, the small-diameter cavity 92D is structured as a constraint cavity in which to hold the orbiting-side shank 95. Further, a tip end portion 95A of the orbiting-side shank 95 is installed into the scroll-side ball bearing 23 in a condition not to be displaced both in the radius and axial directions.

On the other hand, the orbiting-side shank 95 is installed into the large-diameter cavity 92E of the cap member 92 through clearance fit. The large-diameter cavity 92E is thus structured as an unconstraint cavity in which not to hold the orbiting-side shank 95.

A reference numeral 98 is an unconstraint portion provided on the basal portion of the orbiting-side shank 95. This unconstraint portion 98 is formed as the same manner with the unconstraint portion 88 according to the second embodiment, and arranged between the tip end portion 95A and the large-diameter connecting portion 97. The unconstraint portion 98 is arranged so as to face an inside of the second angular ball bearing 25.

As the same, in the third embodiment of the present invention, it is possible to obtain functional effects substantially identical with the first and the second embodiments. Especially, in the second embodiment, the cap member 92 is provided with the small-diameter cylindrical portion 92F provide on the outer periphery side of the small-diameter cavity 92D where the outer diameter dimension D13 is set less than the one of D14. Here, the outer diameter dimension D13 of the small-diameter cylindrical portion 92F may be set to a smaller value beforehand as discussed above in consideration of that the small-diameter cylindrical portion 92F will be expanded when the orbiting-side shank 95 is inserted into the small-diameter cavity 92D. With this architecture, pressurization to the first angular ball bearing 24 can be prevented from being excessive when the cap member 92 is inserted into the inner ring 24B. Accordingly, extra load applied to the angular ball bearing 24 due to excessive pressurization can be inhibited, whereby life-extension of the angular ball bearing 24 is possible.

Furthermore, the cap member 92 is provided with the large-diameter cylindrical portion 92G placed on the outer circumference side of the large-diameter cavity 92E, the large-diameter cylindrical portion 92G having the outer diameter dimension D14 larger than the outer diameter dimension D13 of the small-diameter cylindrical portion 92F. Accordingly, the outer diameter dimension D14 of the large-diameter cylindrical portion 92G may be set to a larger value beforehand in consideration of pressurization deficit relative to the second angular ball bearing 25. Accordingly, when the cap member 92 is inserted into the inner ring 25B, it can prevent that pressurization to the second angular ball bearing 25 becomes deficient. Based on the above, sufficient pressurization can be given to the angular ball bearing 25 so as to restrain shaking in the axial direction.

Figure 14:
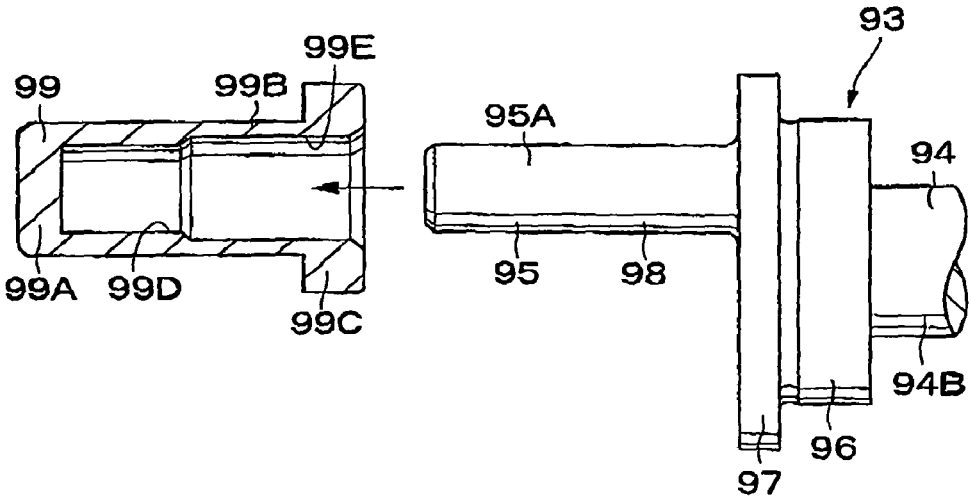
FIG. 14 is a front view showing an assembling state of an auxiliary crank shaft and a cap member according to a third modified example.
Figure 15:
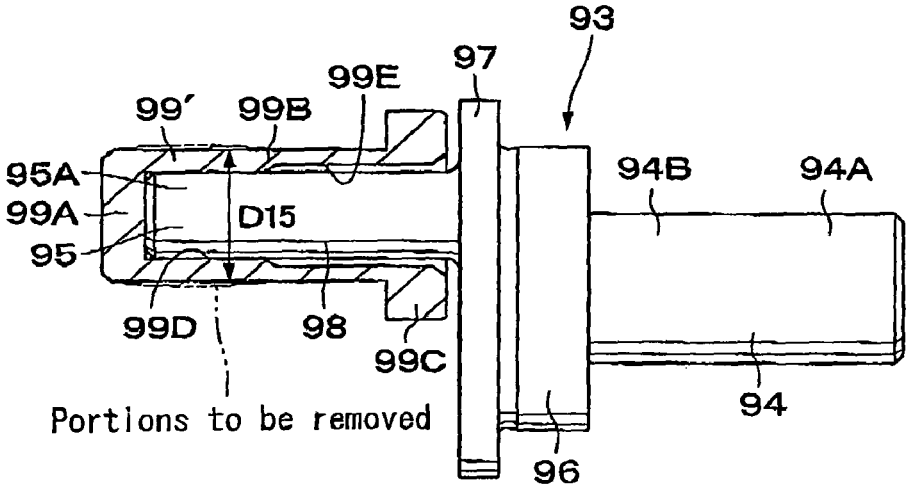
FIG. 15 is a front view showing a state where the auxiliary crank shaft and the cap member of FIG. 14 is installed into a scroll-type ball bearing.

In the third embodiment, the cap member 92 is structured to have the small-diameter cylindrical portion 92F in consideration of the expansion of the small-diameter cylindrical portion 92F along with the insertion of the orbiting-side shank 95. However, the present invention is not limited to this embodiment, but, like a third modified example as shown in FIGS. 14 and 15, in a stage before the orbiting-side shank 95 is inserted into the cap member 99, as the same with the cap member 82 of the second embodiment, the outer diameter dimension of the cap member 99 can be set constant. Here, the cap member 99 comprises: a bottom portion 99A; a cylindrical portion 99B; a brimmed portion 99C; a small-diameter cavity 99D; and a large-diameter cavity 99E. After the orbiting-side shank 95 is inserted into the small-diameter cavity 99D, the outer periphery of the cap member 99 may be processed through cutting, polishing, and the like so as to remove extra-portions expanded outside in the radius direction. Accordingly, as shown in FIG. 15, a cap member 99' with a constant outer diameter dimension can be provided, the outer diameter dimension of the cap member 99' being possibly set to a value identical with the outer diameter dimension D15. In this case, the cap member 99' may be provided with a large-diameter cylindrical portion on the opening side thereof.

Figure 16:
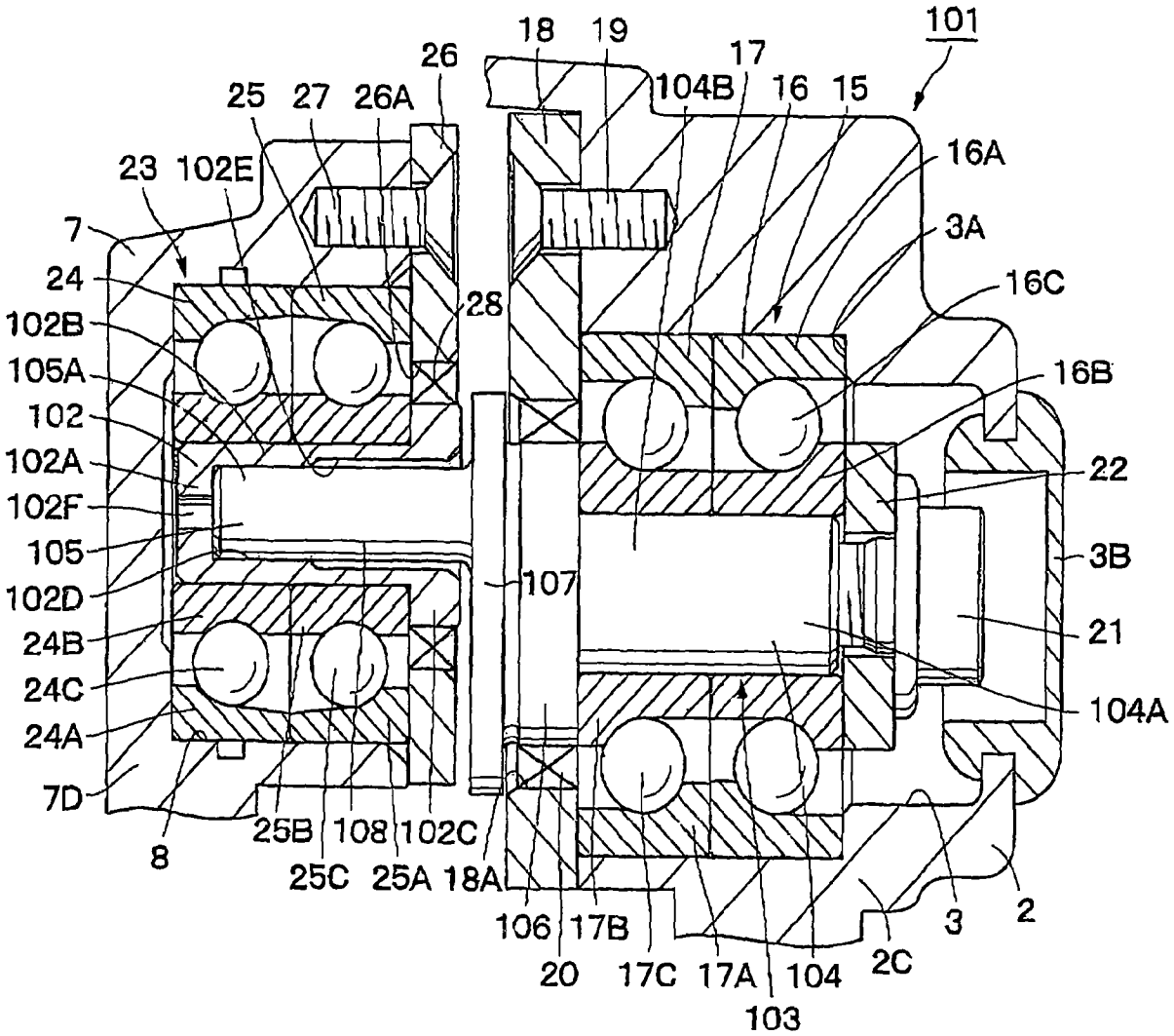
FIG. 16 is an expanded sectional-view expanding an auxiliary crank device according to a fourth embodiment.
Figure 17:
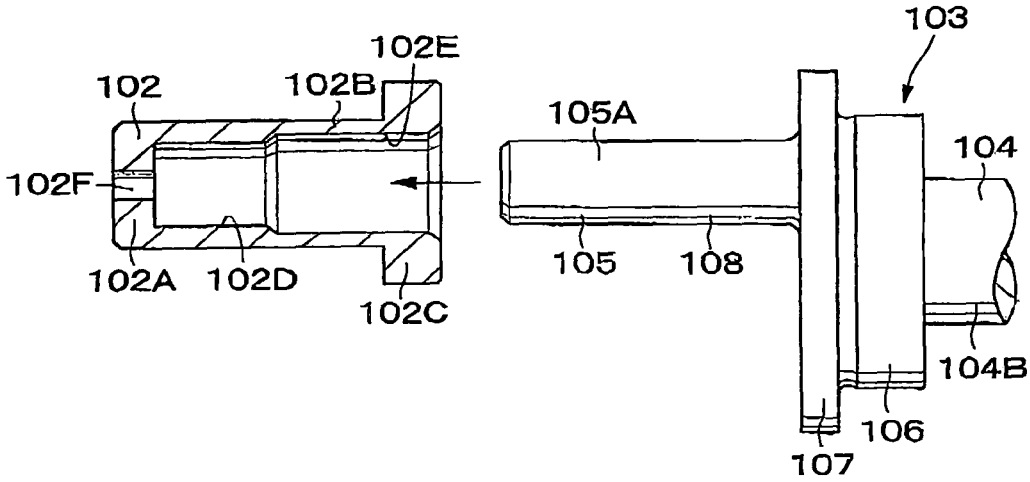
FIG. 17 is a front view showing an assembling state of an auxiliary crank shaft and a cap member of FIG. 16.
Figure 18:
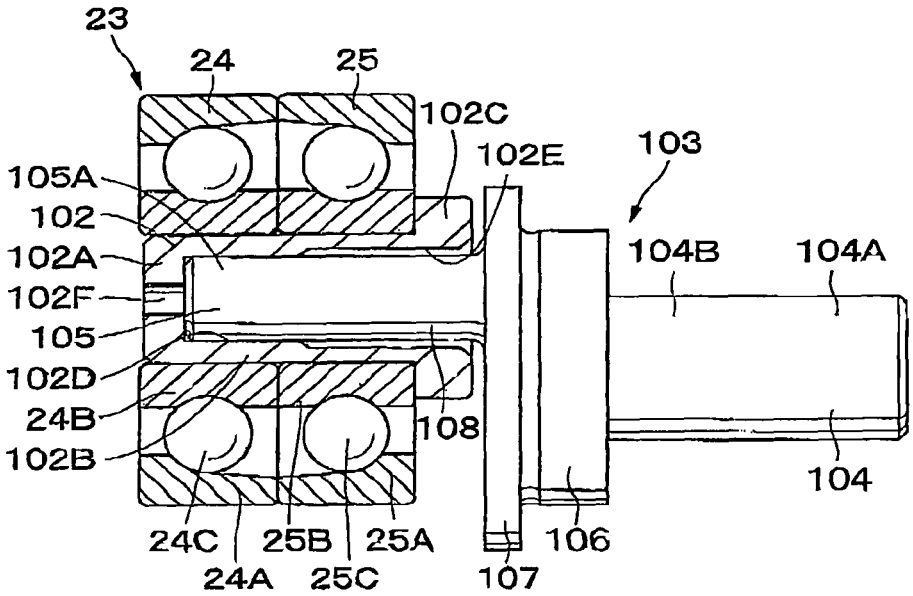
FIG. 18 is a front view showing a state where the auxiliary crank shaft and the cap member of FIG. 16 are installed into a scroll-side ball bearing.

A fourth embodiment of the present invention will be explained with reference to FIGS. 16 to 18. In the fourth embodiment, a bottom portion of a cap member is provided with a communicating portion. The same components as those of the first embodiment will be designated with the same reference numerals and the explanations thereof will be thus omitted.

A reference numeral 101 is an auxiliary crank device according to the fourth embodiment. This auxiliary crank device 101 comprises: the casing-side ball bearing 15, the scroll-side ball bearing 23; a cap member 102; an auxiliary crank shaft 103, and the like.

A reference numeral 102 is a closed-end, cylindrical cap member to be inserted into the inner rings 24B, 25B of the scroll-side ball bearing 23. This cap member 102, as the same with the cap member 82 of the second embodiment, comprises: a bottom portion 102A; a cylindrical portion 102B; and a brimmed portion 102C. An interior of the cap member 102 is provided with a stepped cavity composed of a small-diameter cavity 102D and a large-diameter cavity 102E, as the same with the small-diameter cavity 82D and the large-diameter cavity 82E of the cap member 82. The cap member 102 is press-fitted into the inner rings 24B, 25B so as to rotate with the inner rings 24B, 25B in an integral manner.

The cap member 102 is, however, different from the cap member 82 in that the bottom portion 102A of the cap member 102 is provided with a communicating passage 102F penetrated in the axial direction. This communicating passage 102F is, for example, formed into a through hole, a circular in section, having an inner diameter dimension less than an inner diameter dimension of the small-diameter cavity 102D, and the communicating passage 102F communicates between the inner side and the outer side of the cap member 102.

A reference numeral 103 is an auxiliary crank shaft provided between the casing-side ball bearing 15 and the scroll-side ball bearing 23. This auxiliary crank shaft 103, as the same with the auxiliary crank shaft 83 of the second embodiment, comprises: a fixed-side shank 104; a rotating-side shank 105; a flange portion 106; and a large-diameter connecting portion 107. Here, a tip end portion 104A of the fixed-side shank 104 is arranged so as to face the inner ring 16B while a basal portion 104B of the fixed-side shank 104 is arranged so as to face the inner ring 17B.

The orbiting-side shank 105 is inserted into the small-diameter cavity 102D of the cap member 102 through, for example, press-fit. Here, the small-diameter cavity 102D is structured as a constraint cavity in which to hold the orbiting-side shank 105. A tip end portion 105A of the orbiting-side shank 105 is installed into the scroll-side ball bearing 23 in a condition not to be displaced both in the radius and axial directions.

On the other hand, the orbiting-side shank 105 is inserted into the large-diameter cavity 102E of the cap member 102 through clearance fit. Accordingly, the large-diameter cavity 102E is structured as an unconstraint cavity in which not to hold the orbiting-side shank 105.

A reference numeral 108 is an unconstraint portion provided on the basal portion side of the orbiting-side shank 105. This unconstraint portion 108 is formed as the same manner with the unconstraint portion 88 according to the second embodiment, and arranged between the tip end portion 105A and the large-diameter connecting portion 107. The unconstraint portion 108 is arranged so as to face an inside of the second angular ball bearing 25.

In the fourth embodiment of the present invention as structured, functional effects substantially identical with the first and the second embodiments can be obtained. Especially, in the fourth embodiment, the communicating passage 102F is provided on the bottom portion 102A of the cap member 102. Accordingly, when the orbiting-side shank 105 is inserted into the small-diameter cavity 102D, air remaining between the bottom portion 102A and the orbiting-side shank 105 can be discharged outside the cap member 102 through the communicating passage 102F.

Since this architecture offers no incidence where air is enclosed between the bottom portion 102A and the orbiting-side shank 105, air resistance can be removed when the orbiting-side shank 105 is inserted into the cap member 102, whereby the tip of the orbiting-side shank 105 can be securely abutted against the bottom portion 102A. Accordingly, thrust load acted on the cap member 102 can securely work on the auxiliary crank shaft 103 through the tip of the orbiting-side shank 105. Further, the orbiting-side shank 105 can be observed through the communicating passage 102F. That is, since insertions of the orbiting-side shank 105 can be visually observed through the communicating passage 102F, the orbiting-side shank 105 can be securely inserted into the cap member 102 until surely reaching to the bottom portion 102A.

In the fourth embodiment, the bottom portion 102A of the cap member 12 is provided with the communicating passage 102F, whereby the communicating passage 102F is closed by means of the tip of the orbiting-side shank 105. However, the present invention is not limited to this embodiment, instead, a projecting portion insertable into a communicating passage may be provided on a tip of an orbiting-side shank of an auxiliary crank shaft.

In this case, in addition that the small-diameter cavity 102D is fitted into the orbiting-side shank 105, the projecting portion can be fitted into the communicating passage 12F, whereby it is possible that centric axes of both the cap member 102 and the orbiting-side shank 105 can be securely accommodated.

Further, since the projecting portion is inserted into the communicating passage 102F, it is possible to easily confirm the insertion position of the orbiting-side shank 105 by observing the tip of the projecting portion. Especially, in case that a height dimension of the projecting portion and a length dimension of the communicating passage 102F are both set identical, when the tip of the orbiting-side shank 105 comes into contact with the bottom portion 102A, the tip surface of the projecting portion and the tip surface of the cap member 102 becomes the identical surface. Accordingly, it is possible to easily confirm whether the tip of the orbiting-side shank 105 is in contact with the bottom portion 102A.

Here, the orbiting-side shank of the auxiliary crank shaft may be provided with a reception portion receiving thrust force at some intermediate places on the orbiting-side shank. Further, between the inner ring of the scroll-side ball bearing and the orbiting-side shank of the auxiliary crank shaft, a cylindrical member may be provided, the cylindrical member having a stepped cavity where both axial ends thereof is opened.

In the above embodiment, functional effects substantially identical with the first embodiment can be obtained. Especially, in this embodiment, as the same with the fourth embodiment, when the orbiting-side shank is inserted into the cylindrical member, it is possible to discharge air enclosed in the cylindrical member, contributing to advanced assembly.

Further, since the orbiting-side shank can be observed through opening of the cylindrical member, inserted position of the orbiting-side shank can be visually confirmed.

Figure 19:
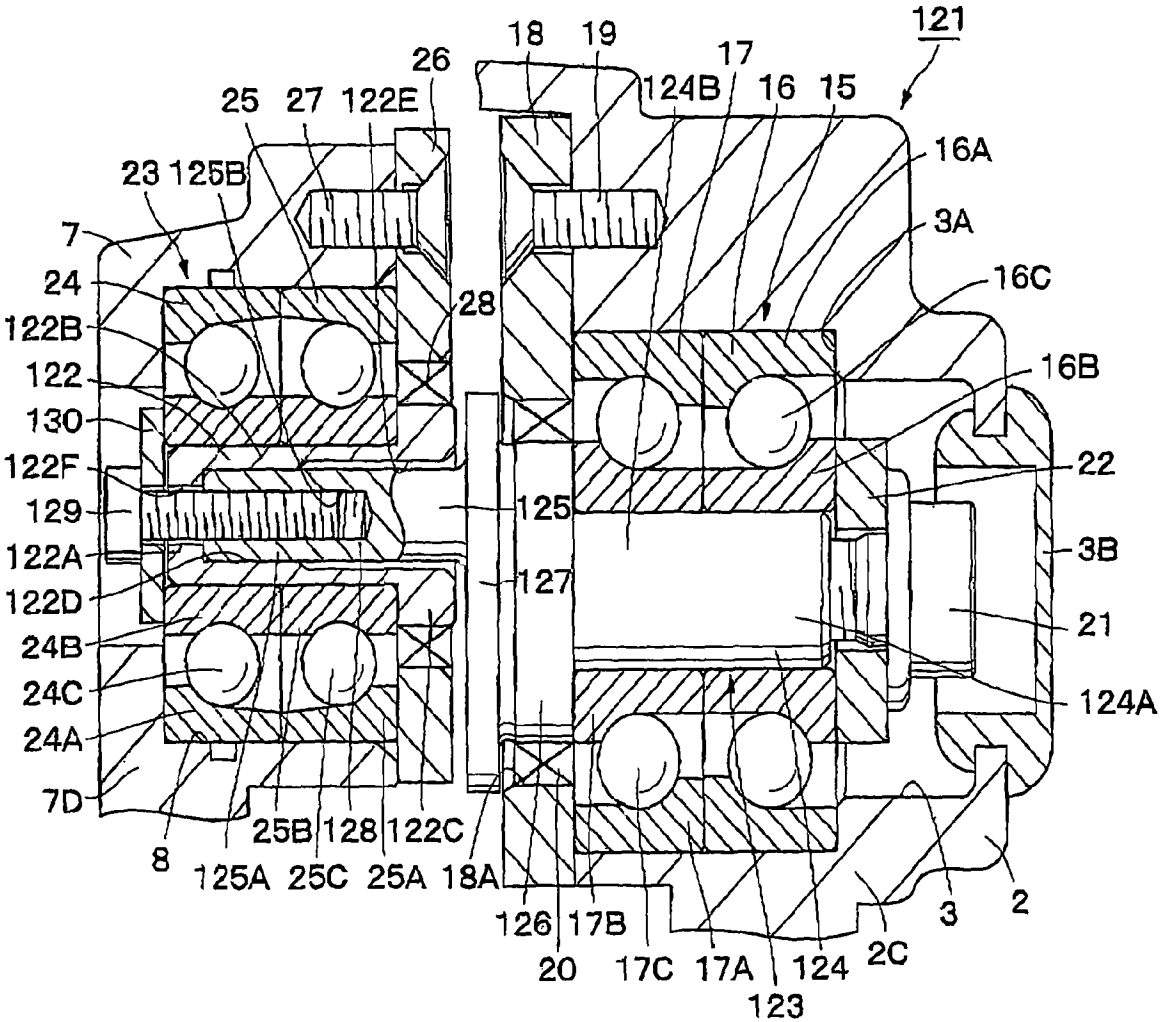
FIG. 19 is an expanded sectional-view expanding an auxiliary crank device according to a fifth embodiment.

Next, a fifth embodiment of the present invention will be explained with reference to FIGS. 19 and 20. In the fifth embodiment, a bolt is provided on a bottom portion side of a cap member, the bolt being screwed into an orbiting-side shank through a bolt insertion hole provided on the bottom portion of the cap member. Two inner rings of a scroll-side ball bearing are axially pinched between the bolt and a brimmed portion of the cap member. In the fifth embodiment, the same components as those of the first embodiment will be designated with the same reference numerals and the explanations thereof will be thus omitted.

A reference numeral 121 is an auxiliary crank device according to the fifth embodiment. This auxiliary crank device 121 comprises: the casing-side ball bearing 15; the scroll-side ball bearing 23; a cap member 122; an auxiliary crank shaft 123; a bolt 129, and the like.

A reference numeral 122 is a closed-end, cylindrical cap member to be inserted into the inner rings 24B, 25B of the scroll-side ball bearing 23. This cap member 122, as the same with the cap member 82 of the second embodiment, comprises: a bottom portion 122A; a cylindrical portion 122B; and a brimmed portion 122C. Further, an interior of the cap member 122 is, as the same with the small-diameter cavity 82D and the large-diameter cavity 82E of the cap member 82, provided with a stepped cavity composed of a small-diameter cavity 122D and a large-diameter cavity 122E. The cap member 122 is press-fitted into the inner rings 24B, 25B so as to rotate with the inner rings 24B, 25B in an integral manner.

The fifth embodiment is, however, different from the cap member 82 in that an axially-penetrated bolt insertion hole 122F is formed on the bottom portion 122A of the cap member 122. This bolt insertion hole 122F is formed with a bore diameter dimension into which the later-explained bolt 129 is insertable, whereby the bolt insertion hole 122F communicates between inside and outside of the cap member 122.

A reference numeral 123 is an auxiliary crank shaft provided between the casing-side ball bearing 15 and the scroll-side ball bearing 23. This auxiliary crank shaft 123, as the same with the auxiliary crank shaft 83 according to the second embodiment, comprises: a fixed-side shank 124; a scroll-side shank 125; a flange portion 126; and a large-diameter connecting portion 127. In this case, a tip end portion 124A of the fixed-side shank 124 is arranged so as to face the inner ring 16B while a basal portion 124B of the fixed-side shank 124 in arranged so as to face the inner ring 17B.

The orbiting-side shank 125 is inserted into the small-diameter cavity 122D of the cap member 122 through, for example, press-fit. In this case, the small-diameter cavity 122D is structured as a constraint cavity in which to hold the orbiting-side shank 125. Further, a tip end portion 125A of the orbiting-side shank 125 is installed into the scroll-side ball bearing 23 in a condition not to be displaced both in the radius and axial directions. Still further, the orbiting-side shank 125 is provided with a bolt hole 125B extended from the tip surface to the basal side of the orbiting-side shank 125. In this case, a female thread is formed on the bolt hole 125B, and the later-explained bolt 129 will be screwed thereinto.

The orbiting-side shank 125 is installed into the large-diameter cavity 122E of the cap member 122 through clearance fit. Accordingly, the large-diameter cavity 122E is formed as an unconstraint cavity in which not to hold the orbiting-side shank 125.

A reference numeral 128 is unconstraint portion provided on the basal portion side of the orbiting-side shank 125. This unconstraint portion 128 is formed in the same manner as the unconstraint portion 88 according to the second embodiment and arranged between the tip end portion 125A and the large-diameter connecting portion 127. The unconstraint portion 128 is arranged so as to face an inside of the second angular ball bearing 25.

A reference numeral 129 is a bolt provided on the scroll-side ball bearing 23 side and work as a screwing member along with a washer 130. This bolt 129 is screwed into the bolt hole 125B of the orbiting-side shank 125 while the washer 130 is intervened between the bolt 129 and the orbiting-side shank 125. The washer 130 is abutted against the inner ring 24B of the scroll-side ball bearing 23. Accordingly, by tightening the bolt 129, a couple of the inner rings 24B, 25B are pinched between the brimmed portion 122C of the cap member 122 and the washer 130. The bolt 129 thus forms the cap member 122 and the inner rings 24B, 25B in an integral manner.

Also, in the fifth embodiment of the present invention as discussed above, functional effects substantially identical with the first and second embodiments can be obtained. Especially, in the fifth embodiment, the bolt 129 screwed into the orbiting-side shank 125 is provided on the bottom portion 122A side of the cap member 122. Further, a couple of the inner rings 24B, 25B of the scroll-side ball bearing 23 are axially pinched between the bolt 129 and the brimmed portion 122C of the cap member 122, whereby the cap member 122 and the inner rings 24B, 25B can be securely combined. Accordingly, even if the inner rings 24B, 25B tend to be relatively displaced due to the unconstraint portion 128, those inner rings 24B, 25B can be displaced together with the cap member 122, whereby the relative displacement of the inner rings 24B, 25B can be restrained. Fretting between the inner rings 24B, 25B (see portion a in FIG. 20) can be suppressed.

Figure 20:
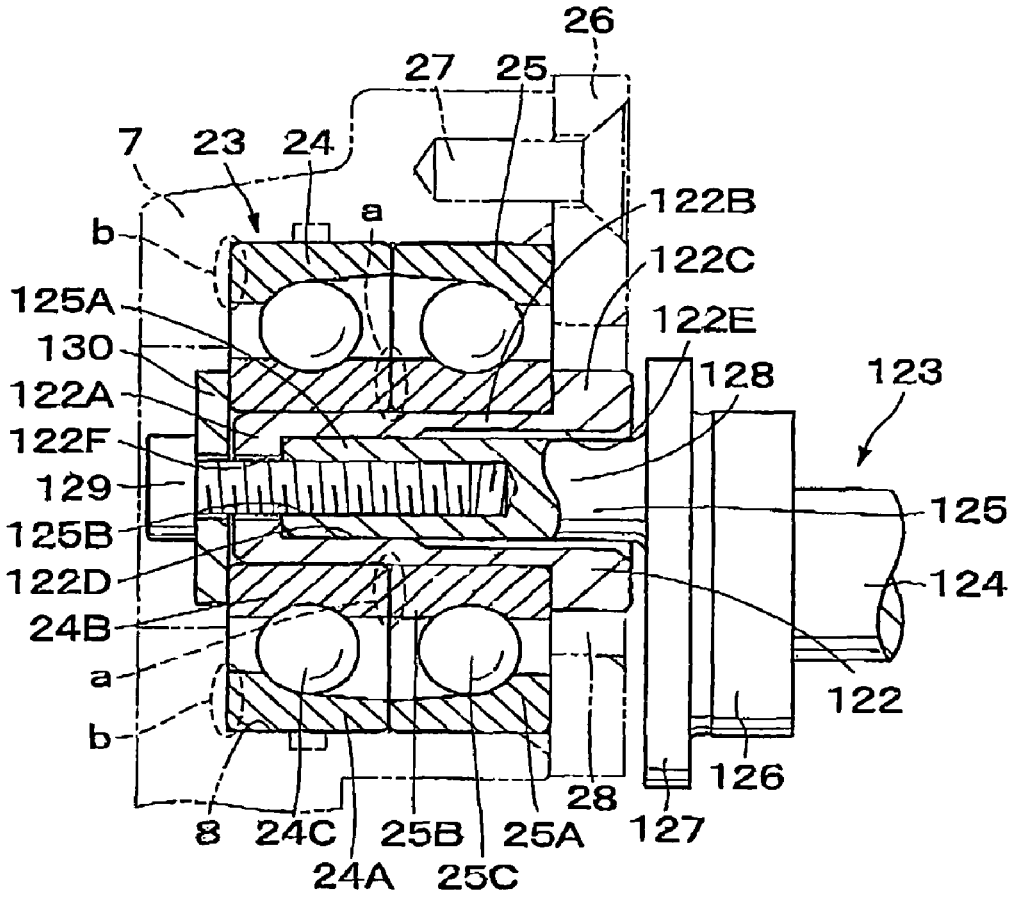
FIG. 20 is a front view showing a state where an auxiliary crank shaft and a cap member of FIG. 19 are installed into a scroll-side ball bearing.

Here, in case that the unconstraint portion 128 is formed on the orbiting-side shank 125 side, tendency can be found that fretting occurs between the inner ring 24B and the bottom surface of the bearing holder 8 (see b portion in FIG. 20). Accordingly, it is preferable that rigidity of the keep plate 26 is increased so as to advance pressurizing force of the keep plate 26 applied to the outer ring 25A. Considering methods to enhance rigidity of the keep plate 26, for example, a thickness of the keep plate may be increased, or the keep plate 26 may be formed with hard materials.

Through the first modified example to the fifth embodiment, the orbiting-side shank 69, 85, 95, 105, 115, 125 and the unconstraint portion 74, 88, 98, 108, 118, 128 of the auxiliary crank shaft 67, 83, 93, 103, 113, and 123 are all formed as solid body. However, the present invention is not limited to this embodiment, instead, the orbiting-side shank may be provided with an axial hole while the unconstraint portion may be formed into a hollow structure.

Also, through the first modified example to the fifth embodiment, the auxiliary crank shafts 45, 67, 83, 93, 103, 113, 123 are structured in that the orbiting-side shanks 47, 69, 85, 95, 105, 115, 125 are provided with the unconstraint portions 52, 74, 88, 98, 108, 118, 128. However, instead of the orbiting-side shanks 47, 69, 85, 95, 105, 115, 125, it is possible that the fixed-side shanks 46, 68, 84, 94, 104, 114, 124 may be provided with the unconstraint portion. Still further, the orbiting-side shanks 47, 69, 85, 95, 105, 115, 125 and the fixed-side shanks 46, 68, 84, 94, 104, 114, 124 may be both formed with the unconstraint portion.

Moreover, in each of the embodiments, the auxiliary crank devices 14, 41, 61, 81, 91, 101, 111, 121 are provided between the casing 2 and the orbiting scroll 7. However, the present invention is not limited to this embodiment, but, for example, the auxiliary crank device may be provided between the orbiting scroll and the fixed scroll.

Still further, in each of the embodiments, the scroll-type air compressor 1 is exemplified as scroll-type fluid machines. However, the present invention is not limited to this embodiment, instead, the present invention is applicable to refrigerant compressors compressing refrigerant, vacuum pumps, expansion devices, and the like.

What is claimed is:

1. A scroll-type fluid machine comprising:

a casing;

a fixed scroll with a spiral lap portion vertically standing on a surface of an end plate, the fixed scroll being fixed to the casing;

an orbiting scroll with a spiral lap portion vertically standing on a surface of an end plat, the orbiting scroll forming a plurality of fluid chambers between the fixed scroll and the orbiting scroll so as to compress or expand fluid in orbiting motion of the orbiting scroll; and an auxiliary crank device in which to prevent the orbiting scroll from being rotated, wherein:

the auxiliary crank device comprises: a fixed-side bearing body provided on a casing side; an orbiting-side bearing body provided on an orbiting scroll side; and an auxiliary crank shaft in which a fixed-side shank is rotatably supported with the fixed-side bearing body, and an orbiting-side shank is rotatably supported with the orbiting-side bearing body;

a tip portion of the fixed-side shank of the auxiliary crank shaft is fixed in a radius direction, and a tip portion of the orbiting-side shank of the auxiliary crank shaft is fixed in a radius direction; and between the tip portion of the fixed-side shank and the tip portion of the orbiting-side shank of the auxiliary crank shaft, a deformative portion, which has lower rigidity in a radius direction compared to the fixed-side shank and the orbiting-side shank, allowed to be deformed in a radius direction is provided.

2. The scroll-type fluid machine according to claim 1, wherein the deformative portion is formed as a connecting portion in which to connect the fixed-side shank with the orbiting-side shank, both of the shanks being a part of the auxiliary crank shaft.

3. The scroll-type fluid machine according to claim 1, wherein the deformative portion is formed as a hollow structure where an interior of the deformative portion is spaced.

4. A scroll-type fluid machine comprising:

a casing;

a fixed scroll with a spiral lap portion vertically standing on a surface of an end plate, the fixed scroll being fixed to the casing;

an orbiting scroll with a spiral lap portion vertically standing on a surface of an end plat, the orbiting scroll forming a plurality of fluid chambers between the fixed scroll and the orbiting scroll so as to compress or expand fluid in orbiting motion of the orbiting scroll; and an auxiliary crank device in which to prevent the orbiting scroll from being rotated, wherein:

the auxiliary crank device comprises: a fixed-side bearing body provided on a casing side; an orbiting-side bearing body provided on an orbiting scroll side; and an auxiliary crank shaft in which a fixed-side shank is rotatably supported with the fixed-side bearing body, and an orbiting-side shank is rotatably supported with the orbiting-side bearing body;

a tip portion of the fixed-side shank of the auxiliary crank shaft is fixed in a radius direction, and a tip portion of the orbiting-side shank of the auxiliary crank shaft is fixed in a radius direction; and between the tip portion of the fixed-side shank and the tip portion of the orbiting-side shank of the auxiliary crank shaft, a deformative portion allowed to be deformed in a radius direction is provided; and the deformative portion is formed with an outer diameter smaller than outer diameters of both the fixed-side shank and the orbiting-side shank of the auxiliary crank shaft.

* * * * *